US008215380B2

(12) United States Patent
Li et al.

(10) Patent No.: US 8,215,380 B2
(45) Date of Patent: Jul. 10, 2012

(54) HOT WATER HEAT TRANSFER PIPE

(75) Inventors: Zhi xin Li, Beijing-shi (CN); Ji an Meng, Beijing-shi (CN); Mitsuharu Numata, Sakai (JP); Kazushige Kasai, Sakai (JP)

(73) Assignees: Tsinghua University, Beijing (CN); Daikin Industries, Ltd., Osaka (JP)

( * ) Notice: Subject to any disclaimer, the term of this patent is extended or adjusted under 35 U.S.C. 154(b) by 959 days.

(21) Appl. No.: 11/884,877

(22) PCT Filed: May 11, 2005

(86) PCT No.: PCT/JP2005/008609

§ 371 (c)(1),
(2), (4) Date: Aug. 22, 2007

(87) PCT Pub. No.: WO2006/103788

PCT Pub. Date: Oct. 5, 2006

(65) Prior Publication Data

US 2008/0149309 A1 Jun. 26, 2008

(30) Foreign Application Priority Data

Mar. 25, 2005 (CN) ..... 2005 1 0056765

(51) Int. Cl.
*F28F 1/42* (2006.01)

(52) U.S. Cl. ..... 165/177; 165/179; 165/172

(58) Field of Classification Search ..... 165/177, 165/179, 181, 172

See application file for complete search history.

(56) References Cited

U.S. PATENT DOCUMENTS

| | | | | | |
|---|---|---|---|---|---|
| 2,611,585 | A | * | 9/1952 | Boling | 165/164 |
| 3,826,304 | A | * | 7/1974 | Withers et al. | 165/179 |
| 3,902,552 | A | * | 9/1975 | McLain | 165/179 |
| 4,690,211 | A | * | 9/1987 | Kuwahara et al. | 165/177 |
| 5,839,505 | A | * | 11/1998 | Ludwig et al. | 165/177 |
| 2001/0052411 | A1 | * | 12/2001 | Pantow et al. | 165/152 |
| 2007/0000651 | A1 | | 1/2007 | Guo et al. | |

FOREIGN PATENT DOCUMENTS

| | | | |
|---|---|---|---|
| CN | 2293790 | Y | 10/1998 |
| CN | 1451937 | A | 10/2003 |
| JP | 61-289293 | A | 12/1986 |
| JP | 02-070317 | A | 3/1990 |

(Continued)

OTHER PUBLICATIONS

Korean Office Action of the corresponding Korean Application No. 10-2007-7024525 dated May 17, 2010.

*Primary Examiner* — Teresa Walberg
(74) *Attorney, Agent, or Firm* — Global IP Counselors

(57) ABSTRACT

The present invention relates to a hot water heat transfer pipe that exchanges heat between its interior and exterior. A plurality of projections, each having a height in the range of 0.8-2.0 mm or 0.1-0.25 times the inner diameter, is provided in at least one part of an inner surface of a portion of the heat transfer pipe positioned in a section where the Reynolds number of the fluid flowing in the interior is less than 7,000 to improve the heat transfer performance in the low Reynolds number zone and minimize pressure loss inside the pipe.

9 Claims, 18 Drawing Sheets

FOREIGN PATENT DOCUMENTS

| | | | |
|---|---|---|---|
| JP | 03-20577 | A | 1/1991 |
| JP | 03-56077 | U | 5/1991 |
| JP | 04-073598 | A | 3/1992 |
| JP | 06-070556 | B2 | 9/1994 |
| JP | 06-70556 | B2 | 9/1994 |
| JP | 07-110174 | A | 4/1995 |
| JP | 07-32375 | U | 6/1995 |
| JP | 09-243284 | A | 9/1997 |
| JP | 10-115495 | A | 5/1998 |
| JP | 11-108577 | A | 4/1999 |
| JP | 11-211378 | A | 8/1999 |
| JP | 2000-304485 | A | 11/2000 |
| JP | 2001-124480 | A | 5/2001 |
| JP | 2003-056995 | A | 2/2003 |
| JP | 2004-085090 | A | 3/2004 |
| JP | 2004-190923 | A | 7/2004 |
| JP | 2005-009833 | A | 1/2005 |

* cited by examiner

H1=1mm

H1=1mm

HOT WATER HEAT TRANSFER PIPE

CROSS-REFERENCE TO RELATED APPLICATIONS

This U.S. National stage application claims priority under 35 U.S.C. §119(a) to Chinese Patent Application No. 200510056765.8 filed in China on Mar. 25, 2005, the entire contents of which are hereby incorporated herein by reference.

The present invention relates to hot water heater technology, and more particularly relates to a hot water heat transfer pipe wherein the Reynolds number Re of a fluid flowing inside the pipe is less than 7,000.

BACKGROUND ART

Heat exchangers used in air conditioners, hot water heaters, and the like, are provided with a heat transfer pipe, wherein a fluid such as water flows, that exchanges heat due to the temperature differential between the pipe interior and exterior. Furthermore, to improve the heat transfer performance of the heat transfer pipe, it is known to use a grooved pipe, wherein grooves are formed on the pipe inner surface. In addition, a technology has also been proposed that improves heat transfer performance by providing projections on the inner surface of the heat transfer pipe.

Providing projections inside the heat transfer pipe in this manner increases the heat transfer surface area of the heat transfer pipe and agitates the fluid, thereby increasing the coefficient of heat transfer of the heat transfer surface and improving the heat transfer performance. However, if projections are provided inside the heat transfer pipe, then the projections increase the pipe coefficient of friction and raise the pressure loss of the flow inside the pipe. Therefore, a technology has been proposed (Japanese Examined Patent Application No. H06-70556) that provides projections 0.45-0.6 mm in height inside the heat transfer pipe, thereby suppressing the pressure loss while promoting the transfer of heat with the refrigerant.

SUMMARY OF THE INVENTION

However, if the flow speed of the fluid inside the heat transfer pipe is extremely low, and the flow of the fluid inside the pipe is in the transition zone where the flow transitions from the laminar flow zone to the turbulent flow zone, then the improvement in the heat transfer performance is small, even if projections are provided whose height is 0.45-0.6 mm, as disclosed in the Patent Document 1.

Consider an example wherein, to efficiently utilize inexpensive nighttime electric power, the water in a heat pump type hot water heater, as shown in FIG. 1, is heated in a single pass from approximately 10° C. to approximately 90° C. over a long period of time. In this case, the flow volume of the water flowing inside the heat transfer pipe is set to an extremely small value (e.g., 0.8 L/min) in order to make the product compact and to ensure high efficiency. Thus, in a heat transfer pipe wherein the water flow volume inside the pipe is small, a method is employed that improves the heat transfer performance by reducing the inner diameter of the heat transfer pipe, thereby increasing the flow speed inside the pipe. However, even in this case, the water flow volume inside the pipe is small, the water flow inside the pipe is therefore in the transition zone (Re=1500-3000) where the flow transitions from the laminar flow zone to the turbulent flow zone in the vicinity of the inlet, and is approximately in the initial stage turbulent flow (Re=7,000) even in the vicinity of the outlet. In addition, efficient heat exchange cannot be expected because the thermal conductivity is also small in the low temperature section in the vicinity of the water inlet.

It is an object of the present invention to overcome the abovementioned problems of the background art, and to provide a hot water heat transfer pipe wherein, with a simple structure, the heat transfer performance in the low Reynolds number zone is improved, and the pressure loss inside the pipe is small.

The hot water heat transfer pipe according to the first aspect of the present invention is a hot water heat transfer pipe that exchanges heat between its interior and exterior, wherein a plurality of projections each having a height H1 of 0.8-2.0 mm is provided in at least one part of the inner surface of a portion positioned in a section where the Reynolds number Re of a fluid flowing in the interior is less than 7,000.

If the height of the projections provided inside the pipe is set low, as in the conventional art, then the effect of improving the heat transfer performance is not obtained in the low Reynolds number section arising in the laminar flow zone or in the transition from the laminar flow zone to the turbulent flow zone.

Consequently, a plurality of projections that protrude toward the inside of the pipe and have a height of 0.8-2.0 mm is provided on the inner surface of the portion positioned at the low Reynolds number section arising in the laminar flow zone and in the transition from the laminar flow zone to the turbulent flow zone, i.e., in the section where the Reynolds number Re is less than 7,000. As a result, the projections provided inside the pipe improve the coefficient of heat transfer, and have little impact on the pressure loss inside the pipe, thereby improving the performance of the entire hot water heat transfer pipe.

The hot water heat transfer pipe according to the second aspect of the present invention is a hot water heat transfer pipe that exchanges heat between its interior and exterior, wherein a plurality of projections each whose height H1 is 0.1-0.25 times an inner diameter D is provided in at least one part of the inner surface of a portion positioned in a section where the Reynolds number Re of a fluid flowing in the interior is less than 7,000.

If projections are provided inside the pipe, then the pipe coefficient of friction becomes a function of the Reynolds number Re and the relative roughness. Herein, the ratio of the height of the projections provided inside the pipe to the pipe inner diameter (i.e., the relative roughness) is used to represent the impact of the projections inside the pipe on the pipe coefficient of friction. Setting the relative roughness of the pipe inner wall surface in the low Reynolds number section, arising in the transition from the laminar flow zone to the turbulent flow zone, to a prescribed range improves the heat transfer effect, and allows for minimizing the impact of the pressure loss.

Further, a plurality of projections each whose height H1 is 0.1-0.25 times the inner diameter D is provided on the inner surface of the portion positioned in the low Reynolds number section arising in the laminar flow zone and in the transition from the laminar flow zone to the turbulent flow zone, i.e., in the section where the Reynolds number Re is less than 7,000. As a result, the projections provided inside the pipe improve the coefficient of heat transfer, and reduce the impact on the pressure loss inside the pipe, thereby improving the performance of the entire hot water heat transfer pipe.

The hot water heat transfer pipe according to the third aspect of the present invention is a hot water heat transfer pipe used in a heat exchanger of a hot water heater and that exchanges heat between its interior and exterior, wherein a plurality of projections each whose height H1 is 0.8-2.0 mm is provided on the inner surface of a portion positioned in the vicinity of an inlet into which water, which is the fluid flowing in the interior, flows.

The flow of the water in the vicinity of the inlet of the heat transfer pipe used in the hot water heat exchanger corresponds to the laminar flow zone and/or a transition zone where the flow transitions from the laminar flow zone to the turbulent flow zone. However, the water temperature in the vicinity of the inlet of the heat transfer pipe is low, and the coefficient of heat transfer is also low. Accordingly, in the present invention, a plurality of projections each having a height of 0.8-2.0 mm is provided on the inner surface of the portion positioned at least in the vicinity of the water inlet, thereby improving the coefficient of heat transfer due to the projections provided inside the pipe. In addition to improving the coefficient of heat transfer due to the projections, the impact of the projections on the pressure loss inside the pipe is small, thereby improving the performance of the entire hot water heat transfer pipe.

The hot water heat transfer pipe according to the fourth aspect of the present invention is a hot water heat transfer pipe used in a heat exchanger of a hot water heater and that exchanges heat between its interior and exterior, wherein a plurality of projections each whose height H1 is 0.1-0.25 times the inner diameter D is provided on the inner surface of a portion positioned in the vicinity of a fluid inlet into which water, which is the fluid flowing in the interior, flows.

In the hot water heat exchanger, the flow of the water in the vicinity of the inlet of the heat transfer pipe corresponds to the laminar flow zone and/or the transition zone where the flow transitions from the laminar flow zone to the turbulent flow zone. In addition, the water temperature in the vicinity of the inlet of the heat transfer pipe is low, and the coefficient of heat transfer is also low. Accordingly, in this hot water heat exchanger, a plurality of projections each whose height is 0.1-0.25 times the heat transfer pipe inner diameter is provided on the inner surface of the heat transfer pipe positioned at least in the vicinity of the water inlet. As a result, the coefficient of heat transfer due to the projections provided inside the pipe is improved, and the impact of the projections on the pressure loss inside the pipe is suppressed, thereby improving the performance of the entire hot water heat transfer pipe.

The hot water heat transfer pipe according to the fifth aspect of the present invention is the hot water heat transfer pipe as recited in any one of the first through the fourth aspect of the present invention, wherein the flow speed of the fluid flowing in the interior is 0.1-0.6 m/s. Furthermore, it is preferable that the flow speed of the fluid flowing inside the hot water heat transfer pipe is 0.2-0.4 m/s. Further, if the flow speed of the fluid inside the pipe is less than 0.1 m/s, then the coefficient of heat transfer of the heat transfer pipe is extremely low. However, if the flow speed of the fluid inside the pipe exceeds 0.6 m/s, then the friction factor inside the pipe increases, and the pressure loss inside the pipe increases. Accordingly, the range of the flow speed of the fluid flowing in the interior is set to 0.1-0.6 m/s. As a result, the coefficient of heat transfer due to the projections provided inside the pipe improves, and the impact of the projections on the pressure loss inside the pipe is suppressed, thereby improving the performance of the entire hot water heat transfer pipe.

The hot water heat transfer pipe according to the sixth aspect of the present invention is the hot water heat transfer pipe as recited in any one of the first through the fourth aspect of the present invention, wherein the cross sectional shape at an arbitrary height of each projection is a smooth curve like a circle, an ellipse, or an approximate circle.

Examples of factors due to the projections inside the pipe that impact the pressure loss of the fluid inside the pipe include the Reynolds number and flow speed of the fluid inside the pipe, the height of the projections, as well as the shape of the projections. If the projections are acute angle shaped, then separation vortices are generated by the flow rounding the angle, which increases the pressure loss of the fluid.

Consequently, the cross sectional shape at an arbitrary height of a projection comprises a smooth curve, such as a circle, an ellipse, or an approximate circle. In other words, because the outer circumferential surface of the projections are formed with a smooth curved surface, the generation of separation vortices can be suppressed compared with projections that are acute angle shaped, and the impact of the loss of pressure of the fluid inside the pipe is suppressed, thereby improving the performance of the entire heat transfer pipe.

The hot water heat transfer pipe according to the seventh aspect of the present invention is the hot water heat transfer pipe as recited in any one of the first through the fourth aspect of the present invention, wherein the projections are not provided in a section positioned in the vicinity of a fluid outlet out of which the fluid flows.

If the temperature of the fluid is high at the fluid outlet part of the heat transfer pipe and, for example, the fluid is water, then there is a risk of scaling of the pipe inner surface. If projections are provided in such a section, then there is a risk that the projections will promote scaling. Accordingly, scaling is suppressed by the usage of a pipe not provided with projections, e.g., by using a smooth pipe, in the section positioned in the vicinity of the fluid outlet, where the temperature of the fluid is high.

The hot water heat transfer pipe according to the eighth aspect of the present invention is the hot water heat transfer pipe as recited in any one of the first through the fourth aspect of the present invention, wherein a groove having a depth shallower than the height H1 of each projection is formed on the pipe inner surface.

Among the projections provided on the pipe inner surface in the low Reynolds number zone, the large projections contribute more to the improvement in the coefficient of heat transfer than the small projections. Accordingly, providing inside the pipe projections each whose height is greater than the depth of grooves in a grooved pipe improves the heat transfer effect. However, in the high Reynolds number zone, grooves shallower than the height of the projections contribute to the improvement in the coefficient of heat transfer. Accordingly, in the high Reynolds zone, the heat transfer performance of the heat transfer pipe is further improved by the usage of the grooved pipe, wherein grooves shallower than the height of the projections are formed on the inner surface.

The hot water heat transfer pipe according to the ninth aspect of the present invention is the hot water heat transfer pipe as recited in any one of the first through the fourth aspect of the present invention, wherein the plurality of projections is provided parallel to the pipe axial direction.

Providing projections in the pipe axial direction enables the promotion of heat transfer to be made continuously. In addition, because the fluid flows linearly in the pipe axial direction, the additional pressure loss is small, thereby improving the performance of the entire heat transfer pipe.

The hot water heat transfer pipe according to the tenth aspect of the present invention is the hot water heat transfer pipe as recited in any one of the first through the fourth aspect of the present invention, wherein the plurality of projections is helically provided.

Helically providing the projections generates a turning in the flow of the fluid inside the pipe, and increases the length of the passage of the fluid, thereby further increasing the heat transfer performance.

The hot water heat transfer pipe according to the eleventh aspect of the present invention is the hot water heat transfer pipe as recited in any one of the first through the fourth aspect of the present invention, wherein the plurality of projections is provided so that they are paired at opposing positions in the radial direction of the heat transfer pipe.

Providing projections so that they form pairs at opposing positions in the radial direction reduces the cross sectional area in the vicinity of the projections, promotes the mixing of the fluid, and further improves the heat transfer performance.

The hot water heat transfer pipe according to the twelfth aspect of the present invention is the hot water heat transfer pipe as recited in any one of the first through the fourth aspect of the present invention, wherein the ratio of a pitch P of the plurality of projections to the heat transfer pipe inner diameter D is 0.5-10.

If the ratio of the pitch P of the projections to the heat transfer pipe inner diameter D is less than 0.5, then heat transfer is promoted, and the pressure loss increases due to the effect of the projections on the upstream side. In addition, if the ratio of the pitch P of the projections to the heat transfer pipe inner diameter D is greater than 10, then the promotion of heat transfer decreases.

Therefore, by setting the ratio of the pitch P of the projections to the heat transfer pipe inner diameter D to 0.5-10, the promotion of heat transfer is maintained, while the increase in the pressure loss is small, and the performance of the entire heat transfer pipe improves.

The hot water heat transfer pipe according to the thirteenth aspect of the present invention is the hot water heat transfer pipe as recited in any one of the first through the fourth aspect of the present invention, wherein small projections each whose height (H2) is less than 0.8 mm are provided between the plurality of projections.

In the low Reynolds number zone, the large projections contribute more to the improvement in the coefficient of heat transfer than the small projections, and, in the high Reynolds number zone, the small projections (small projections) contribute more to the improvement in the coefficient of heat transfer than the large projections. Accordingly, providing small projections between the large projections achieves a synergistic effect in that the heat transfer performance due to the large projections is improved in the section where the Reynolds number is low, and the heat transfer performance due to the small projections is improved in the section where the Reynolds number is high, thereby improving the performance of the entire heat exchanger.

The hot water heat transfer pipe according to the fourteenth aspect of the present invention is the hot water heat transfer pipe as recited in any one of the first through the fourth aspect of the present invention, wherein a smooth part not provided with projections exists on the inner surface of the heat transfer pipe.

In the smooth part without projections, the cross sectional area inside the heat transfer pipe is maximal. In other words, there is maximal variation in the shape of the inner surface between the portion where the projections are provided and the portion where the projections are not provided, which improves the heat transfer performance. However, if a smooth part does not exist on the inner surface of the heat transfer pipe, then the effect is the same as that obtained in a heat transfer pipe whose inner diameter is reduced, i.e., the flow speed of the fluid increases and the heat transfer is promoted, but the pressure loss inside the pipe increases.

The hot water heat transfer pipe according to the fifteenth aspect of the present invention is the hot water heat transfer pipe as recited in any one of the first through the fourth aspect of the present invention, wherein the projections are formed by the application of force from the exterior, are formed in a linear part, and are not formed in a bent part.

If the projections are formed on the inner surface of the heat transfer pipe by the application of an external force, then it is often the case that the projections are formed toward the inside of the pipe on the inner surface corresponding to the indented outer surface. In addition, the heat transfer pipe generally has a linear part and a bent part. An additional pressure loss exists in the bent part over and above the pressure loss in the linear part. Therefore, if projections are further provided on the inner surface of the bent part, there is a risk that the pressure loss in the bent part will increase further. In addition, the bending work process creates a large deformation in the concave region of the outer surface of the heat transfer pipe, which creates a risk of breakages, and the like. Therefore, the projections are provided in the linear part, and projections are not provided in the bent part.

The hot water heat transfer pipe according to the sixteenth aspect of the present invention is the hot water heat transfer pipe as recited in any one of the first through the fourth aspect of the present invention, wherein the projections are formed by the application of force from the exterior, and are not formed in a section that intersects the bent surface in the bent part.

In the bent part of the heat transfer pipe, the amount of deformation is greatest in the portion where the bent surface intersects. Therefore, in the bent section of the heat transfer pipe, projections are not provided in the section where the bent surface intersects. For example, if the heat transfer pipe is bent at a horizontal surface, then projections are not provided at the section where the horizontal surface intersects in the bent part.

The hot water heat transfer pipe according to the seventeenth aspect of the present invention is the hot water heat transfer pipe as recited in any one of the first through the fourth aspect of the present invention, wherein a second heat transfer pipe is disposed in the exterior to flow a second fluid that supplies heat to the fluid; the second heat transfer pipe contacts an outer surface; and the projections are formed on the inner surface by indenting the outer surface, and are formed at a location outside of the portion that contacts the second heat transfer pipe.

Herein, the projections are formed on the inner surface by indenting the outer surface, and indentations are consequently formed on the outer surface corresponding to the region where the projections are formed on the inner surface. Projections are formed at the portion of contact with the second heat transfer pipe. In other words, if indentations are formed on the outer surface, then the contact between the heat transfer pipe and the second heat transfer pipe worsens, thereby reducing the heat transfer effect from the second heat transfer pipe. Therefore, by not providing projections in the section of contact with the second heat transfer pipe, it is possible to prevent a reduction in the effect of transferring heat from the second heat transfer pipe.

PREFERRED EMBODIMENTS

The hot water heat transfer pipe according to the present invention will now be explained based on the attached drawings, and the embodiments.

Figure 1:
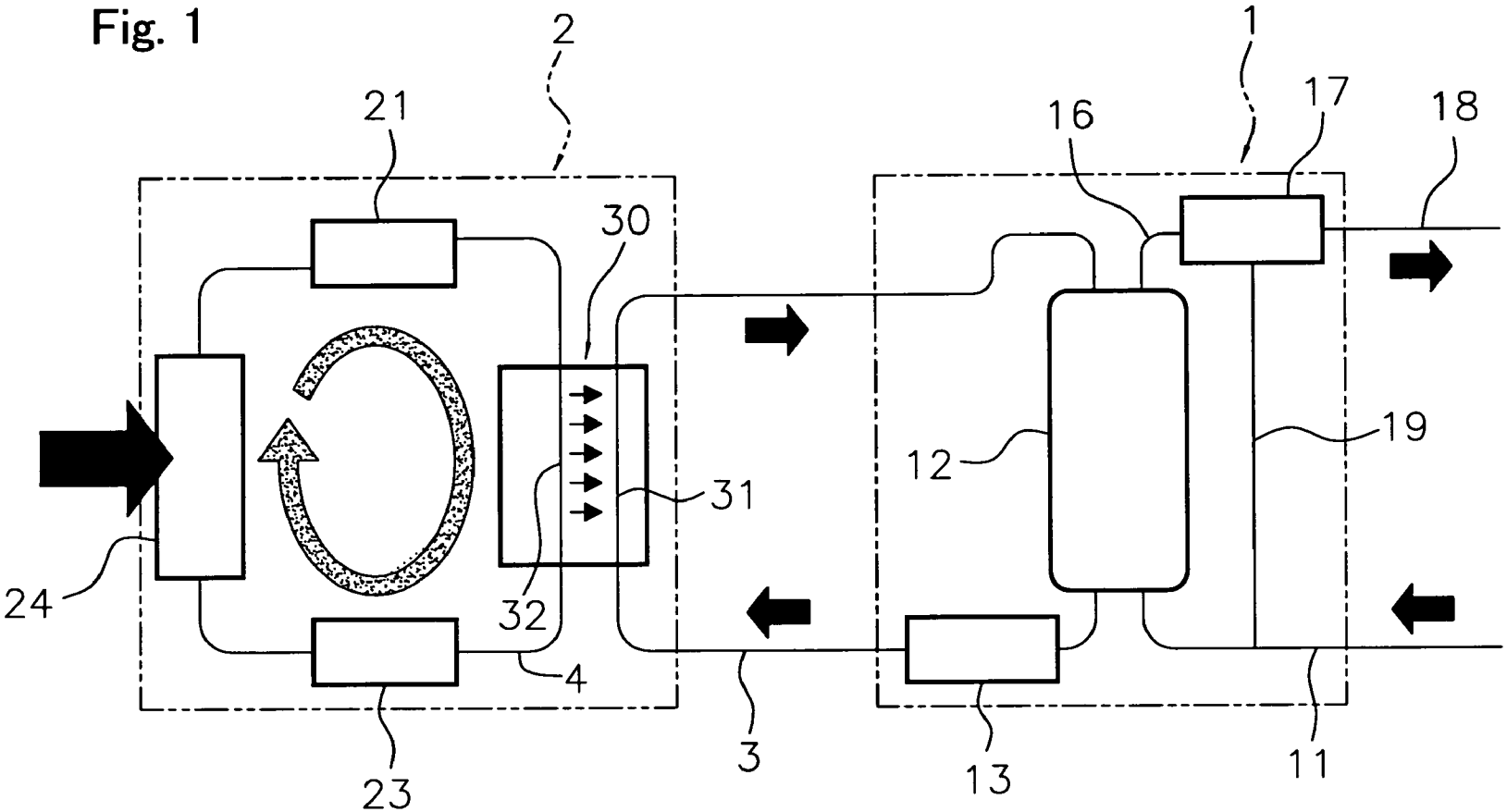
FIG. 1 is a schematic diagram of a heat pump type hot water heater.

FIG. 1 is a schematic diagram of a heat pump type hot water heater that uses the hot water heat transfer pipe of the present invention. Herein, the heat pump type hot water heater comprises a hot water supply unit 1, and a heat pump unit 2. The following are successively coupled in the hot water supply unit 1: a service water pipe 11, a hot water storage tank 12, a water circulation pump 13, a water supply pipe 3, a heat transfer pipe 31 that constitutes a water heat exchanger 30, a hot water pipe 16, a mixing valve 17, and a hot water supply pipe 18. Further, service water is supplied from the water supply pipe 11 to the hot water storage tank 12. Low temperature water is supplied by the water circulation pump 13 from the bottom part of the hot water storage tank 12 to the heat transfer pipe 31 of the water heat exchanger 30, and heated. The heated hot water flows into the upper part of the hot water storage tank 12. The high temperature hot water that exits from the upper part of the hot water storage tank 12 via the hot water pipe 16 is mixed with the cold water of a mixed water pipe 19 by the mixing valve 17. This mixing valve 17 regulates the temperature of the supplied hot water, which is supplied to the user by the hot water supply pipe 18.

Next, the heat pump unit 2 is provided with a refrigerant circulating circuit, comprising a compressor 21, the water heat exchanger 30, an expansion valve 23, and an air heat exchanger 24, connected sequentially by a refrigerant pipe 32. The refrigerant is compressed to a high pressure by the compressor 21, and is then sent to the water heat exchanger 30. The refrigerant whose heat was exchanged in the water heat exchanger 30 passes through the expansion valve 23, and is supplied to the air heat exchanger 24. The refrigerant absorbs heat from the surroundings, and then circulates back to the compressor 21.

Figure 2:
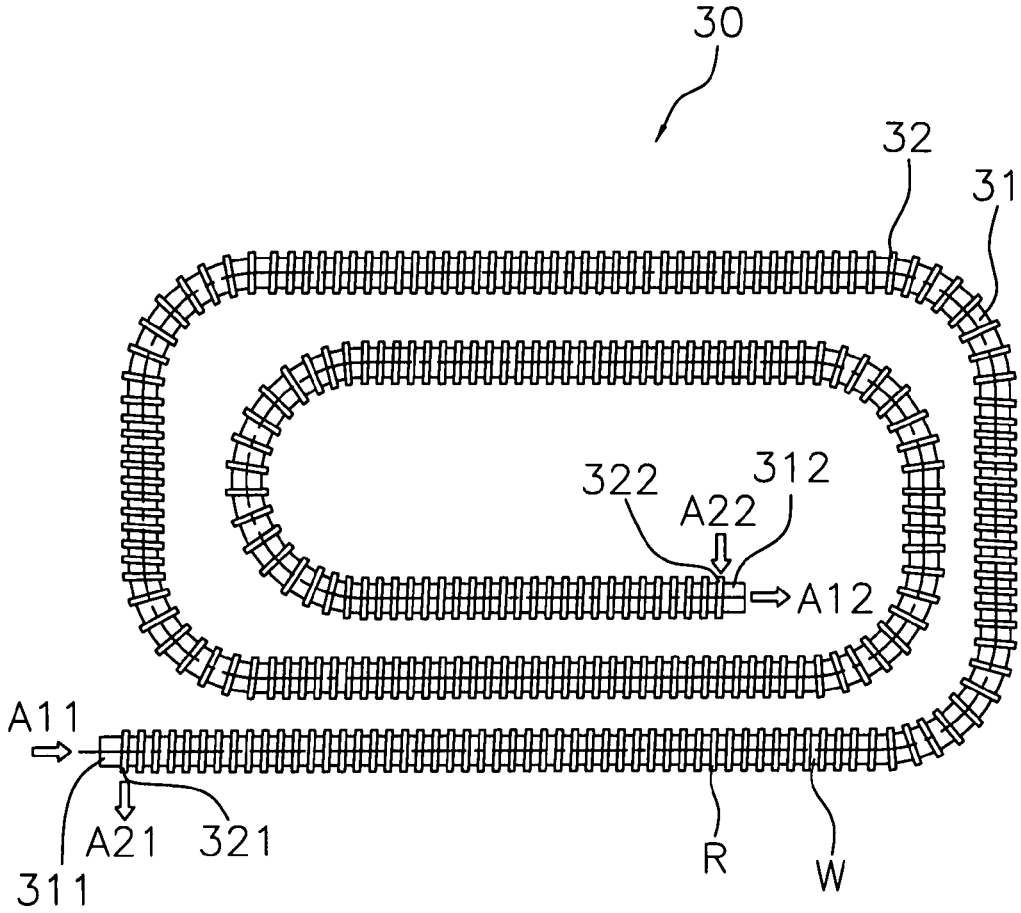
FIG. 2 is a schematic diagram of a water heat exchanger.

FIG. 2 is a schematic diagram of the water heat exchanger 30 in the heat pump type hot water heater. As shown in FIG. 2, the water heat exchanger 30 comprises the heat transfer pipe 31 and the refrigerant pipe 32. The heat transfer pipe 31 is spirally formed in the same plane so that it is oval shaped, and forms a water passageway W. The refrigerant pipe 32 is helically wound around the outer circumference of the heat transfer pipe 31, and forms a refrigerant passageway R. Further, the outer circumferential side of the spiral heat transfer pipe 31 is a water inlet 311, and the center side of the spiral heat transfer pipe 31 is a water outlet 312. In the water heat exchanger 30, the refrigerant inside the refrigerant pipe 32 flows into the refrigerant inlet 322 from the A22 direction, and radiates heat. Subsequently, it flows out of the refrigerant outlet 321 in the A21 direction. The service water supplied into the water inlet 311 from the A11 direction is heated by this heat, turns into hot water, and flows out of the water outlet 312 in the A12 direction.

Figure 3:
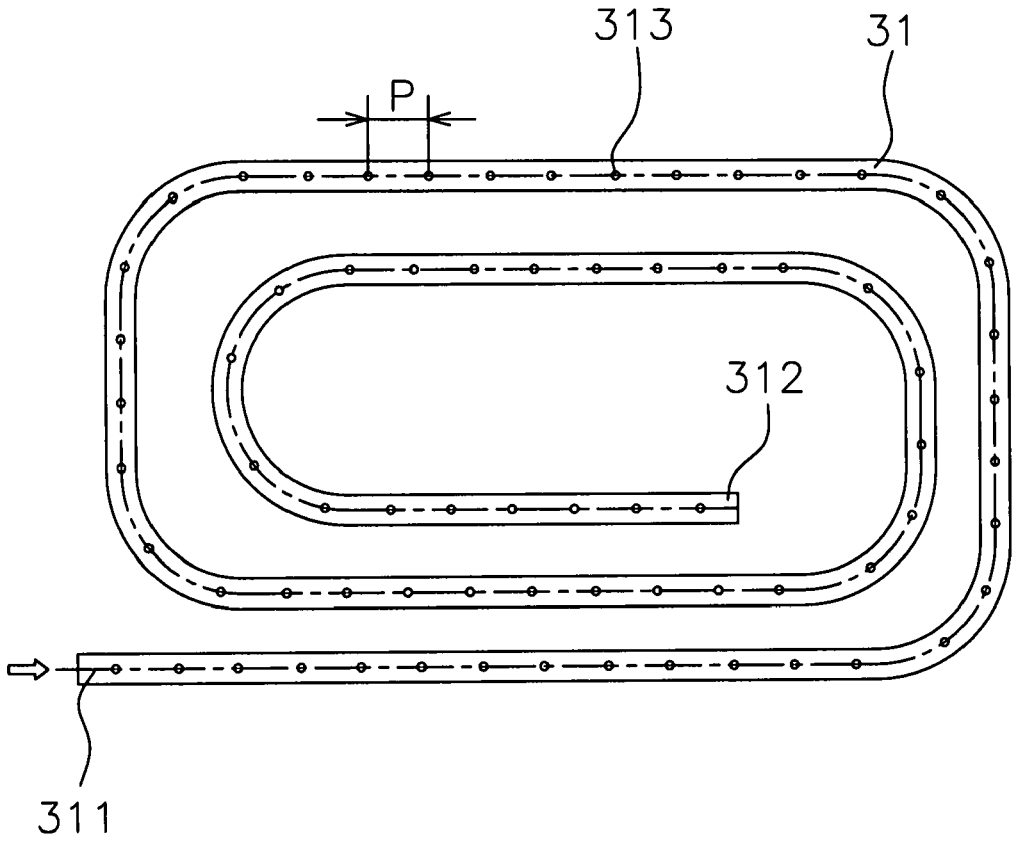
FIG. 3 is a plan view of a heat transfer pipe.

The following explains the heat transfer pipe 31. As shown in FIG. 3, a plurality of projections 313 each having a height H1 is provided vertically symmetric at a 20 mm pitch (refer to P in FIG. 3) in the pipe axial direction on the pipe inner surface of the heat transfer pipe 31. In FIG. 3, only the projections 313 provided upward when viewed from the paper surface direction are shown. In the present embodiment, the water temperature at the water inlet 311 of the heat transfer pipe 31 is set to approximately 10° C., and the water temperature at the water outlet 312 is set to approximately 90° C. Herein, the flow volume of the water in the heat transfer pipe is approximately 0.8 L/min. In addition, the outer diameter of the heat transfer pipe is preferably 8-14 mm (with a 6-12 mm inner diameter).

Figure 4:
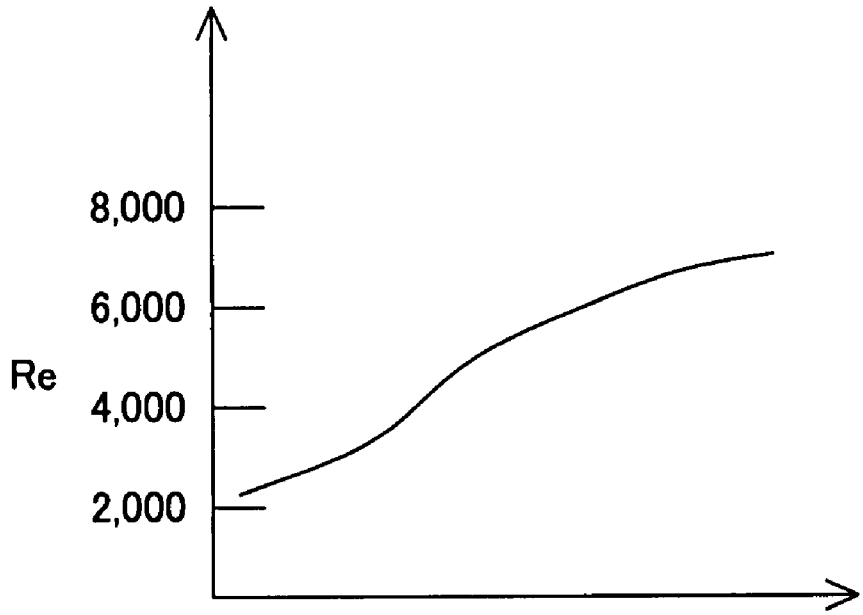
FIG. 4 is a graph that depicts the Reynolds number of the flow inside the heat transfer pipe.

FIG. 4 is a chart of the Reynolds number Re of the flow inside the heat transfer pipe 31. As shown in FIG. 4, the Reynolds number Re at the water inlet 311 of the heat transfer pipe 31 is approximately 2,000, and the flow inside the pipe is in the laminar flow zone. As the water flow advances, the water that flows in from the inlet 311 exchanges heat with the refrigerant pipe 32 shown in FIG. 2, thereby raising the water temperature. The increased water temperature decreases the coefficient of viscosity of the water, which gradually increases the Reynolds number Re. In FIG. 4, the Reynolds number Re at the water outlet 312 is approximately 7,000, and the flow inside the pipe is in the transition zone where the flow transitions from laminar flow to turbulent flow. The following experiments were performed to investigate the impact of the plurality of projections 313 provided on the pipe inner surface of the heat transfer pipe 31 on the improvement in the heat transfer performance, and on the pressure loss.

(1) Experiment 1

Figure 5:
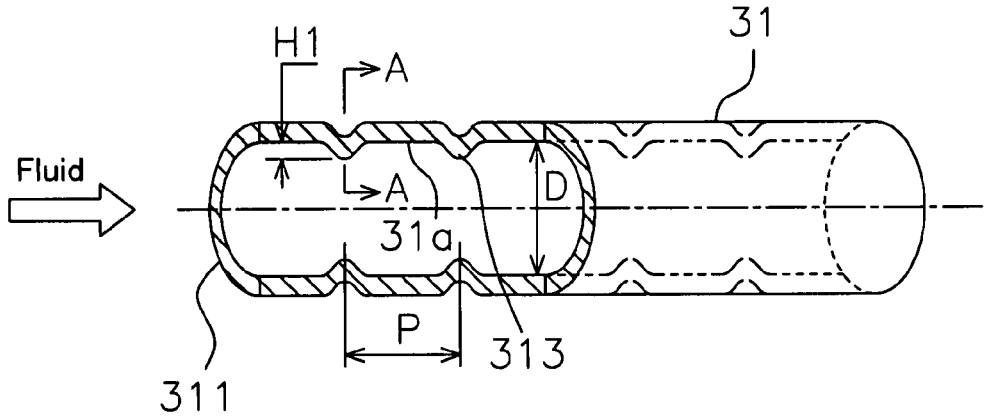
FIG. 5 (*a*) is a cross sectional perspective view of the heat transfer pipe; (*b*) is a cross sectional view taken along the A-A arrow in (*a*); and (*c*) is a cross sectional view taken along the B-B arrow in (*b*).
Figure 5:
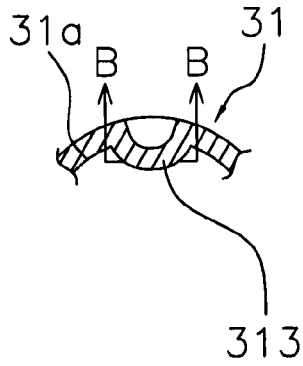
Figure 5C:
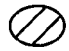
Figure 6:
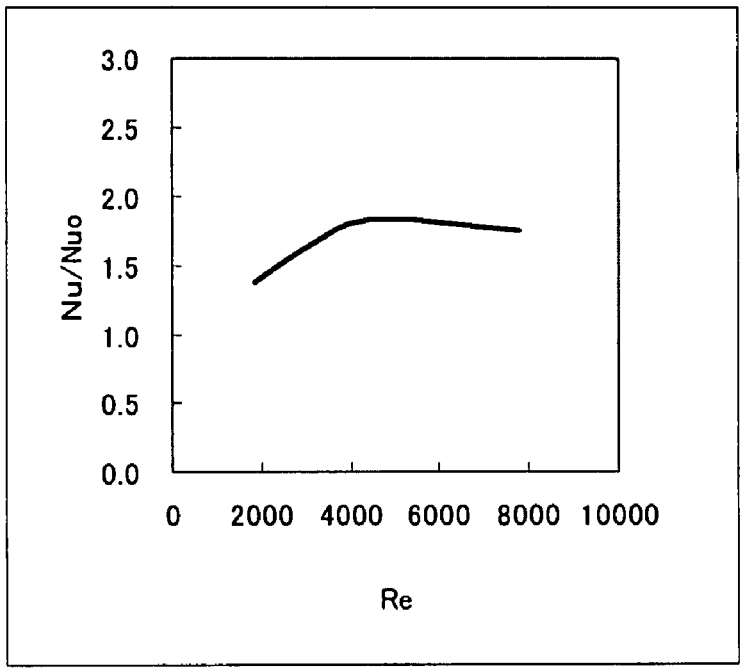
FIG. 6 is a graph of the experiment 1 results.
Figure 6:
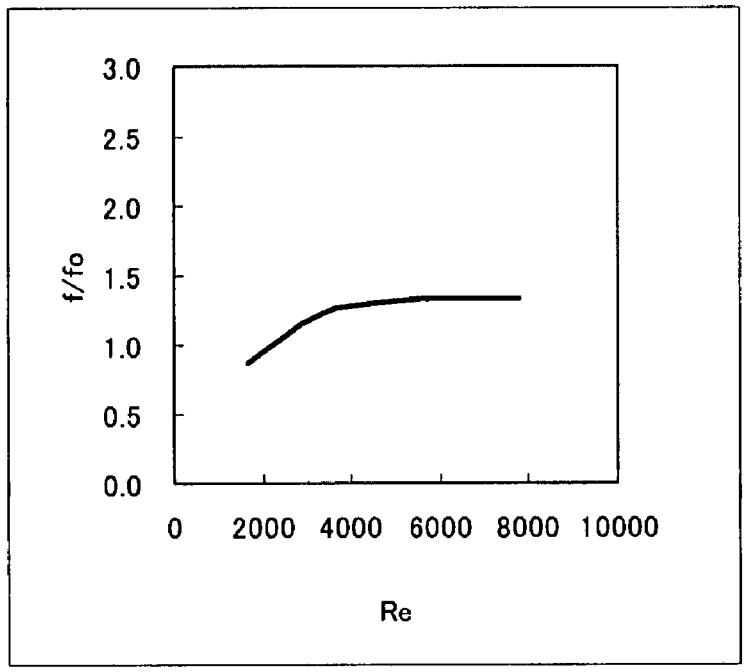

FIG. 5 (*a*) is a cross sectional perspective view of the heat transfer pipe 31. In experiment 1, projections each having a height H1 of 1.0 mm are provided vertically symmetric on the pipe inner surface having an inner diameter D of 8.0 mm so that the pitch P in the pipe axial direction is 20 mm. FIG. 5 (*b*) is a cross sectional view taken along the A-A arrow in FIG. 5 (*a*), and FIG. 5 (*c*) is a cross sectional view taken along the B-B arrow in FIG. 5 (*b*). As can be seen from FIG. 5 (*a*) and FIG. 5 (*b*), the projections 313 are formed on the inner surface by indenting the outer surface of the heat transfer pipe. In addition, as can be seen from FIG. 5 (*c*), each projection 313 is formed so that its shape in the transverse sectional view is elliptical. Further, flat surfaced parts 31*a* not provided with projections exist on the inner surface of the heat transfer pipe 31. FIG. 6 (*a*) graphs, for each Reynolds number Re in the low Reynolds number section arising from the flow inside the pipe being in the laminar flow zone as well as transitioning from the laminar flow zone to the turbulent flow zone, the heat transfer performance for the case in which a smooth pipe not provided with projections is used, and for the case wherein projections 313 each having a height H1 of 1.0 mm are provided vertically symmetric so that the pitch P in the pipe axial direction is 20 mm. Further, the horizontal axis represents the value of the Reynolds number Re. The vertical axis represents the ratio (Nu/Nuo), which is the ratio of the Nusselt number Nu of the heat transfer pipe 31 provided with projections 313 to the Nusselt number Nuo of the smooth heat transfer pipe not provided with projections. Further, the Nusselt number is the coefficient of heat transfer converted to a dimensionless number, which serves as an index of how easily heat transfers from the solid wall to the fluid; the larger that number, the easier that heat conducts from the solid wall to the fluid. Accordingly, the larger the Nu/Nuo value, the greater the improvement in the heat transfer performance of the heat transfer pipe due to the projections. As can be seen from FIG. 6 (*a*), if the Reynolds number Re is less than 4,000, then the improvement in the heat transfer performance due to the projections 313, each whose height H1 is 1.0 mm, is clear. However, if the Reynolds number Re is greater than or equal to 4,000, then the improvement in the heat transfer performance due to the projections 313 provided inside the pipe is modest.

FIG. 6 (*b*) graphs, for each Reynolds number Re in the low Reynolds number section arising from the flow inside the pipe being in the laminar flow zone as well as transitioning from the laminar flow zone to the turbulent flow zone, the trend in the pressure loss inside the pipe for the case of using a smooth pipe not provided with projections, and the case of using a heat transfer pipe 31 provided vertically symmetric with projections 313 each whose height H1 is 1.0 mm so that the pitch P in the pipe axial direction is 20 mm. Further, the horizontal axis represents the value of the Reynolds number Re. The vertical axis represents the ratio (f/fo), which is the ratio of the Fanning friction factor f of the heat transfer pipe 31 provided with projections 313 to the Fanning friction factor fo of the smooth pipe not provided with projections. Here, the Fanning friction factor is a dimensionless number that indicates the pressure loss of the flow inside the pipe. The larger that number, the greater the pressure loss of the flow inside the pipe. Accordingly, the larger the f/fo value, the greater the water pressure loss inside the pipe. As can be seen in FIG. 6 (*b*), if the Reynolds number Re is approximately 2,000, i.e., if the flow inside the pipe is in the laminar flow zone, then the pressure loss inside the heat transfer pipe 31 provided with projections 313 is equivalent to that inside the smooth pipe not provided with projections. However, as the Reynolds number Re increases and the flow inside the pipe transitions from the laminar flow zone to the turbulent flow zone, the pressure loss inside the pipe due to the projections 313 provided on the pipe inner surface also increases; further, if the Reynolds number Re is greater than or equal to 4,000, then the pressure loss inside the pipe remains substantially constant.

(2) Experiment 2

Figure 7:
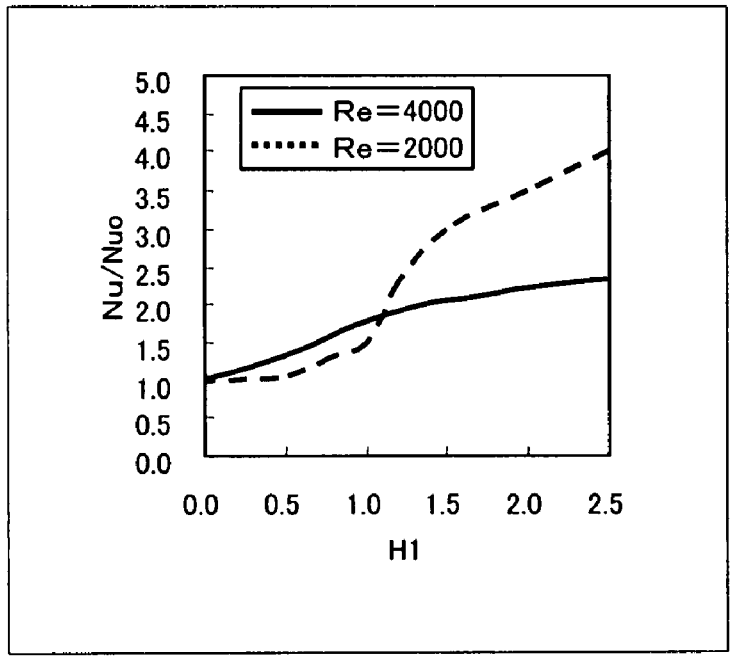
FIG. 7 is a graph of the experiment 2 results.
Figure 7B:
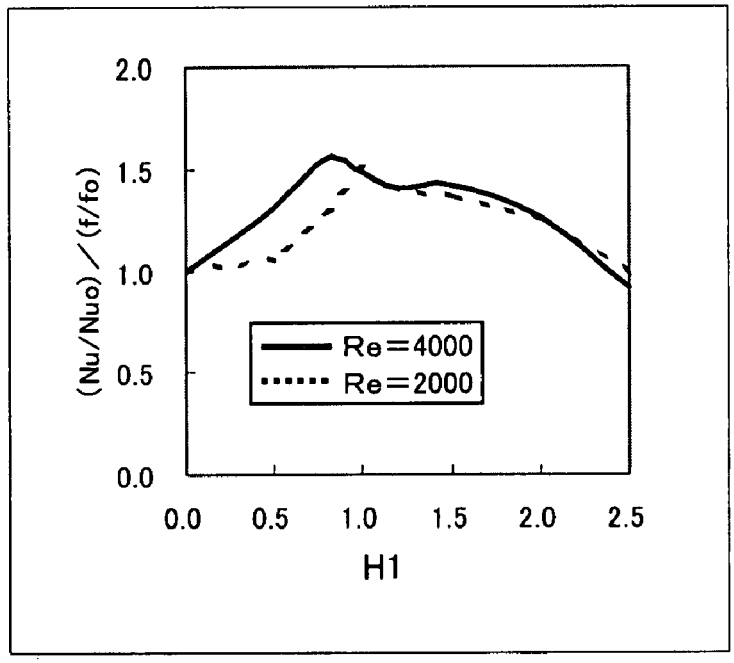

To investigate the impact of the height H1 of the projections 313 on the heat transfer performance and on the pressure loss of the flow inside the pipe, experiment 2 was performed by varying the height H1 of the projections 313 provided on the pipe inner surface. FIG. 7 (*a*) graphs the heat transfer performance for the case in which projections having differing heights H1 are provided vertically symmetric in a heat transfer pipe having an inner diameter D of 8.0 mm so that the pitch P in the pipe axial direction is 20 mm. Further, the horizontal axis represents the value of the height H1 of the projections 313. The vertical axis represents the ratio (Nu/Nuo), which is the ratio of the Nusselt number Nu of the heat transfer pipe 31 provided with projections' 313 to the Nusselt number Nuo of the smooth heat transfer pipe not provided with projections. The solid line represents the experimental results for when the Reynolds number Re was 4,000, and the dotted line represents the experimental results for when the Reynolds number Re was 2,000. As can be seen from FIG. 7 (*a*), the greater the height H1 of the projections 313, the greater the improvement in the heat transfer performance, for both the case in which the Reynolds number Re was 4,000 and 2,000. In addition, as can be seen from the dotted line in FIG. 7 (*a*), the projections 313 yielded virtually no improvement in the heat transfer performance when the height H1 of the projections 313 was less than 0.5 mm and the Reynolds number Re was 2,000. An improvement in the heat transfer performance first appears when the height H1 of the projections 313 rises above 0.8 mm.

FIG. 7 (*b*) graphs the performance of the entire heat transfer pipe for the case in which projections having differing heights H1 were provided vertically symmetric at a 20 mm pitch (in the pipe axial direction) in a heat transfer pipe whose inner diameter D was 8.0 mm. In other words, it represents the performance comprehensively taking into consideration the improvement in the heat transfer performance and the suppression of the pressure loss. Further, the horizontal axis represents the value of the height of the projections. The vertical axis represents the value of the ratio (Nu/Nuo), which is the ratio of the Nusselt number Nu of the heat transfer pipe provided with projections to the Nusselt number Nuo of the smooth heat transfer pipe not provided with projections, divided by the ratio (f/fo), which is the ratio of the Fanning friction factor f of the heat transfer pipe provided with projections to the Fanning friction factor fo of the smooth heat transfer pipe not provided with projections. As discussed above, the larger the Nu/Nuo value, the greater the improvement in the heat transfer performance; and the larger the f/fo value, the greater the water pressure loss inside the pipe. Accordingly, the larger the value of Nu/Nuo divided by f/fo, the greater the improvement in the heat transfer performance, the smaller the impact that the projections have on the pressure loss inside the pipe, and the greater the improvement in the performance of the entire heat transfer pipe.

In FIG. 7 (*b*), the solid line represents the experimental results for the case where the Reynolds number Re was 4,000, and the dotted line represents the experimental results for the case where the Reynolds number Re was 2,000. As can be seen from FIG. 7 (*b*), for both the states when the Reynolds number Re was 2,000 and 4,000, the value of Nu/Nuo divided by f/fo was largest when the height of the projections provided inside the heat transfer pipe was 0.8 mm, and decreased markedly when the height of the projections exceeded 2.0 mm. In other words, in the low Reynolds number section, the performance of the entire heat transfer pipe improved when the height of the projections was in the range of 0.8-2.0 mm. In particular, it is preferable that the height of the projections is in the range of 0.9-1.2 mm.

(3) Experiment 3

Figure 8A:
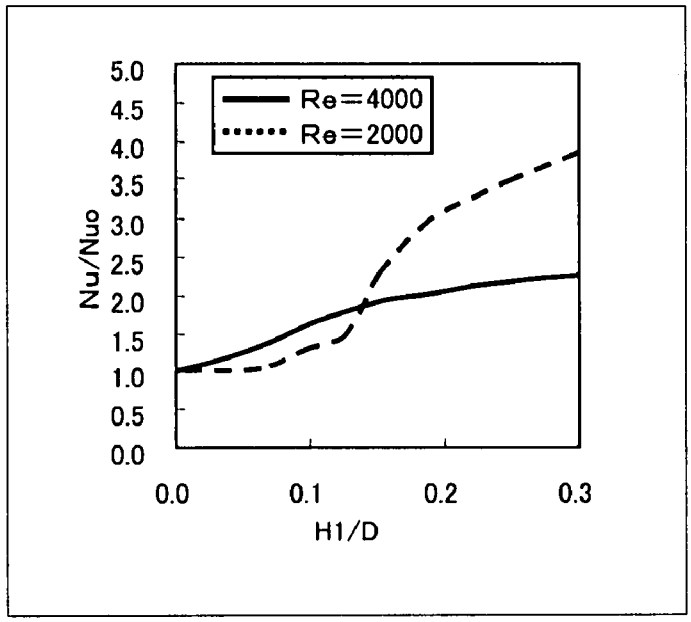
FIG. 8 is a graph of the experiment 3 results.
Figure 8B:
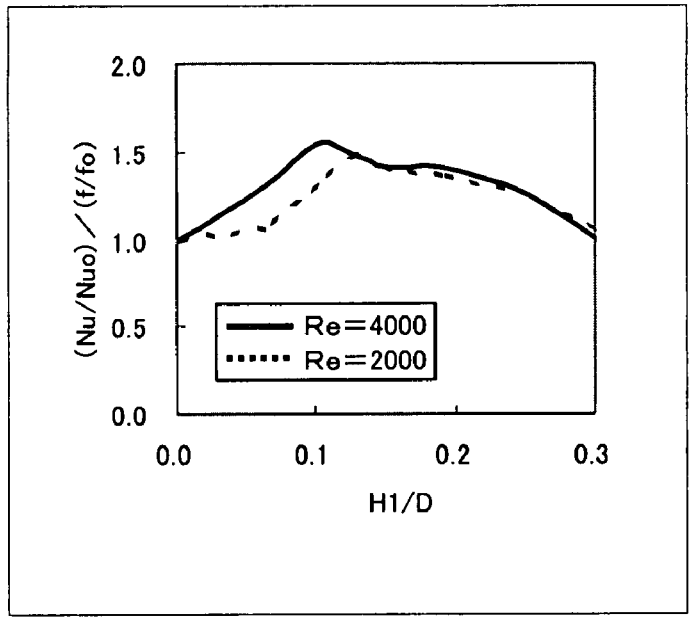

In experiment 3, instead of assigning the height H1 of the projections 313, as is, as an index, the relative roughness (H1/D) serves as the index. To investigate the impact of this relative roughness (H1/D) on the heat transfer performance and on the pressure loss of the flow inside the pipe, this experiment was performed by varying the relative roughness (H1/D). FIG. 8 (*a*) graphs the heat transfer performance by varying the relative roughness (H1/D) in the states when the Reynolds number Re was 2,000 and 4,000, and for the case in which a smooth pipe not provided with projections was employed. Herein, the horizontal axis represents the value of the relative roughness (H1/D). The vertical axis represents the ratio (Nu/Nuo), which is the ratio of the Nusselt number Nu of the heat transfer pipe 31 provided with projections 313 to the Nusselt number Nuo of the smooth heat transfer pipe not provided with projections. As can be seen from FIG. 8 (*a*), the larger the value of the relative roughness (H1/D) of the projections, the greater the improvement in the heat transfer performance. In addition, as can be seen from the dotted line in FIG. 8 (*a*), the projections yield virtually no improvement in the heat transfer performance in the state when the Reynolds number is 2,000 and the value of the relative roughness (H1/D) is less than 0.1.

FIG. 8 (*b*) graphs the performance of the entire heat transfer pipe by varying the relative roughness (H1/D) of the projections for the case in which a smooth pipe not provided with projections was employed. Herein, the horizontal axis represents the value of the relative roughness (H1/D). The vertical axis represents the value of the ratio (Nu/Nuo), which is the ratio of the Nusselt number Nu of the heat transfer pipe provided with projections to the Nusselt number Nuo of the smooth heat transfer pipe not provided with projections, divided by the ratio (f/fo), which is the ratio of the Fanning friction factor f of the heat transfer pipe provided with projections to the Fanning friction factor fo of the smooth heat transfer pipe not provided with projections. As discussed above, the larger the Nu/Nuo value, the greater the improvement in the heat transfer performance; and the larger the f/fo value, the greater the water pressure loss inside the pipe. Accordingly, the larger the value of Nu/Nuo divided by f/fo, the greater the improvement in the coefficient of heat transfer, the smaller the impact of the projections on the pressure loss inside the pipe, and the greater the improvement in the performance of the entire heat transfer pipe. As can be seen from FIG. 8 (*b*), in both states when the Reynolds number Re was 2,000 and 4,000, the value of Nu/Nuo divided by f/fo was largest when the relative roughness (H1/D) of the projections provided inside the heat transfer pipe was 0.1, and that value decreased markedly when the relative roughness (H1/D) of the projections exceeded 0.25. In other words, in the low Reynolds number Re section, the performance of the entire heat transfer pipe improved when the relative roughness (H1/D) of the projections was in the range of 0.1-0.25. It is particularly preferable that the relative roughness (H1/D) of the projections is in the range of 0.11-0.15.

(4) Experiment 4

Figure 9:
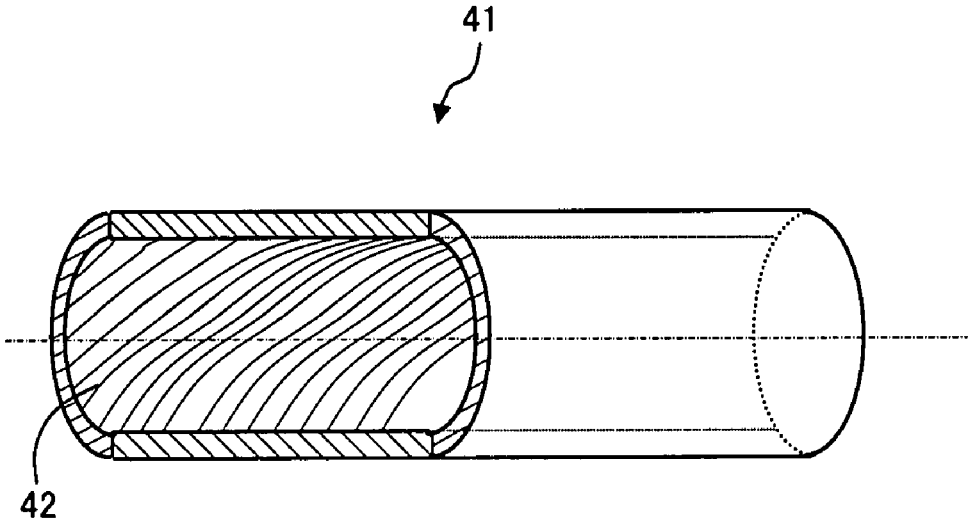
FIG. 9 is a cross sectional perspective view of the heat transfer pipe according to experiment 4.
Figure 10:
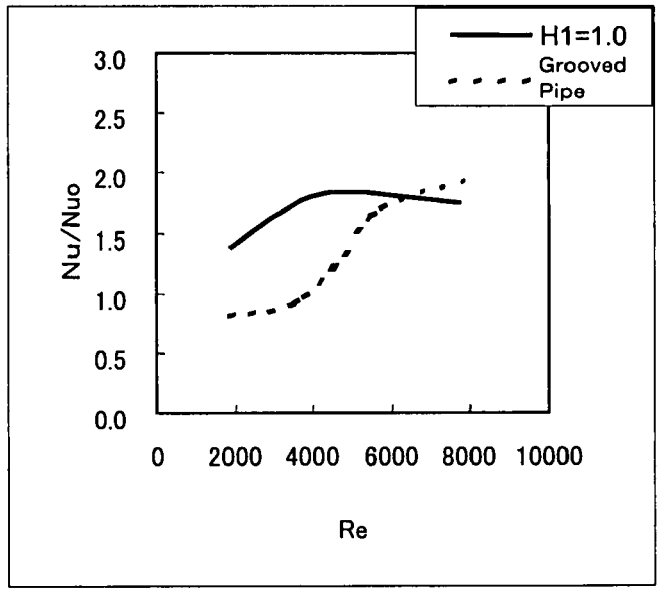
FIG. 10 is a graph of the experiment 4 results.
Figure 10:
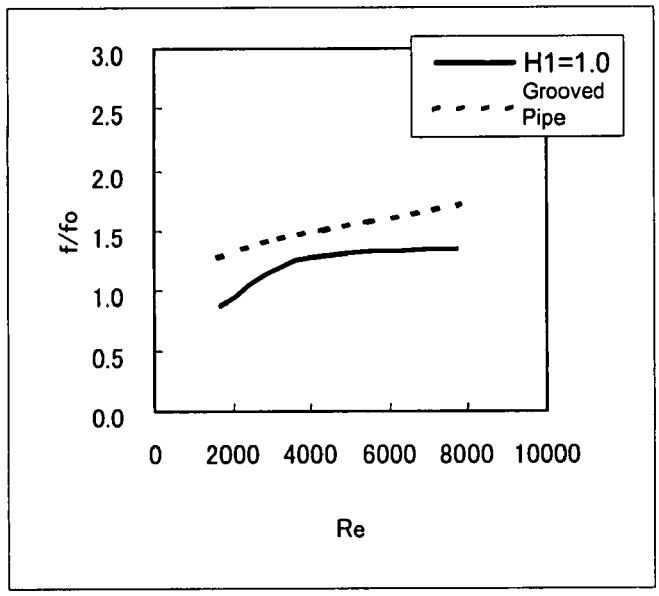

Experiment 4 compares a heat transfer pipe 41 shown in FIG. 9 with the heat transfer pipe 31 shown in FIG. 5. Herein, grooves 42 having a depth of 0.2 mm were provided on the inner surface of the heat transfer pipe 41, shown in FIG. 9, whose inner diameter D was 8.0 mm. Further, the grooves 42 are represented by lines. However, in the heat transfer pipe 31 shown in FIG. 5, a plurality of projections 313 each having a height of H1 was provided vertically symmetric so that their pitch was 20 mm. FIG. 10 (*a*) graphs the heat transfer performance, for each Reynolds number Re in the low Reynolds number section arising from the flow inside the pipe being in the laminar flow zone as well as transitioning from the laminar flow zone to the turbulent flow zone, for the case of employing the heat transfer pipe 41, and for the case of employing the heat transfer pipe 31. Herein, the horizontal axis represents the value of the Reynolds number Re. The vertical axis represents the ratio (Nu/Nuo), which is the ratio of the Nusselt number Nu of the heat transfer pipe 31 and the heat transfer pipe 41 to the Nusselt number Nuo of the smooth heat transfer pipe not provided with projections. Further, the solid line is the experimental data when the heat transfer pipe 31 was employed, and the dotted line is the experimental data when the heat transfer pipe 41 was employed. As can be seen from FIG. 10 (*a*), when the Reynolds number Re is less than 7,000, the improvement in the heat transfer performance due to the heat transfer pipe 31 provided with projections 313 is more marked than the improvement in the heat transfer performance due to the heat transfer pipe 41 provided with grooves 42. However, when the Reynolds number Re is 7,000 or greater, the improvement in the heat transfer performance due to the heat transfer pipe 41 provided with grooves 42 is more marked than the improvement in the heat transfer performance due to the heat transfer pipe 31 provided with projections 313.

FIG. 10 (*b*) graphs the pressure loss inside the pipe, for each Reynolds number Re in the low Reynolds number section arising from the flow inside the pipe being in the laminar flow zone as well as transitioning from the laminar flow zone to the turbulent flow zone, for the case of employing a heat transfer pipe 41, and the case of employing a heat transfer pipe 31. Herein, the horizontal axis represents the value of the Reynolds number Re. The vertical axis represents the ratio (f/fo), which is the ratio of the Fanning friction factor f of the heat transfer pipe 31 and heat transfer pipe 41 to the Fanning friction factor fo of the smooth heat transfer pipe not provided with projections. Herein, the solid line is the experimental data when the heat transfer pipe 31 was employed, and the dotted line is the experimental data when the heat transfer pipe 41 was employed. As can be seen from FIG. 10 (*b*), when the Reynolds number Re is approximately 2,000 in the heat transfer pipe 31, i.e., when the flow inside the pipe is in the laminar flow zone, the pressure loss is on par with the pressure loss inside the smooth pipe. However, as the Reynolds number Re increases and the flow inside the pipe transitions from the laminar flow zone to the turbulent flow zone, the pressure loss inside the pipe due to the projections 313 provided on the pipe inner surface increases. However, when the flow inside the heat transfer pipe 41 is in the laminar flow zone and/or in all sections of the transition zone from the laminar flow zone to the turbulent flow zone, the pressure loss inside the pipe is greater than the pressure loss inside the smooth pipe. In addition, when the flow inside the pipe is in the laminar flow zone and/or in all sections of the transition zone from the laminar flow zone to the turbulent flow zone, the pressure loss inside the heat transfer pipe 41 is greater than the pressure loss inside the heat transfer pipe 31. As can be seen from the above experimental data, the performance of the entire heat transfer pipe 31 is higher than that of the heat transfer pipe 41.

The following embodiments further explain structures that differ from the hot water heat transfer pipe according to the present invention. (In the following embodiments, values such as the inner diameter D, the heights H1, H2 and the pitch of the projections, and the depths of the grooves, are merely for illustrative purposes, and it is also possible to use in these embodiments the values used in the abovementioned experiments, as well as the numerical ranges of the various parameters recited in the claims.)

First Embodiment

Figure 11:
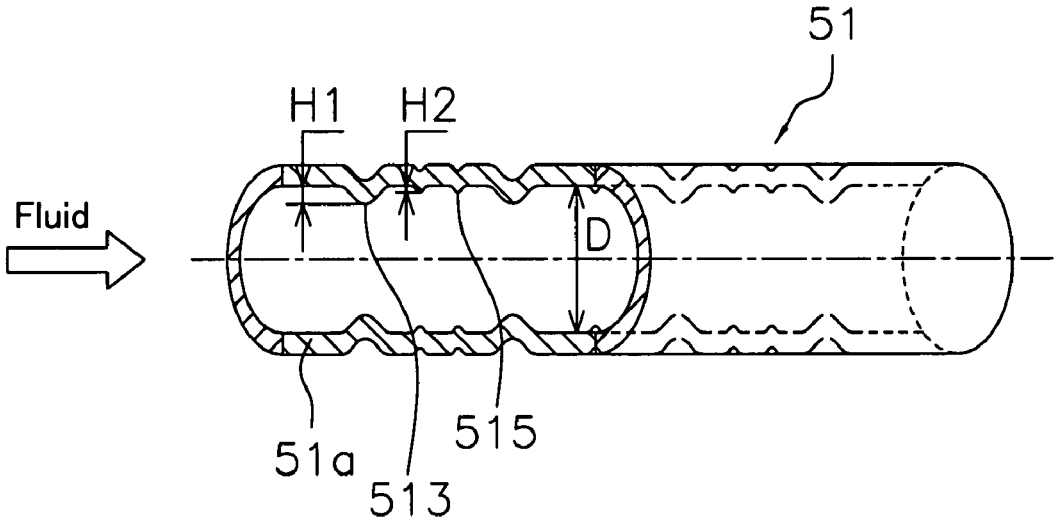
FIG. 11 is a plan view of the heat transfer pipe according to the first embodiment.

The first embodiment uses the heat transfer pipe 31 wherein projections each having a height H1 of 1.0 mm are provided vertically symmetric on the inner surface of the pipe whose inner diameter D is 8.0 mm so that the pitch P in the pipe axial direction is 20 mm. In a heat transfer pipe 51 of the first embodiment, as shown in FIG. 11, small projections 515 each having a height H2 of 0.3 mm are provided between projections 513 each having a height H1 of 1.0 mm. In the low Reynolds number zone, the large projections contribute to the improvement in the coefficient of heat transfer more than the small projections; however, in the high Reynolds number zone, the small projections contribute to the improvement in the coefficient of heat transfer more than the large projections. Therefore, by providing the small projections 515 each whose height H2 is 0.3 mm between the projections 513 each whose height H1 is 1.0 mm, a synergistic effect is achieved in that the projections 513 improve the heat transfer performance in the section where the Reynolds number is low, and the small projections 515 improve heat transfer performance in the section where the Reynolds number is high, thereby improving the performance of the entire heat exchanger.

Second Embodiment

Figure 12A:
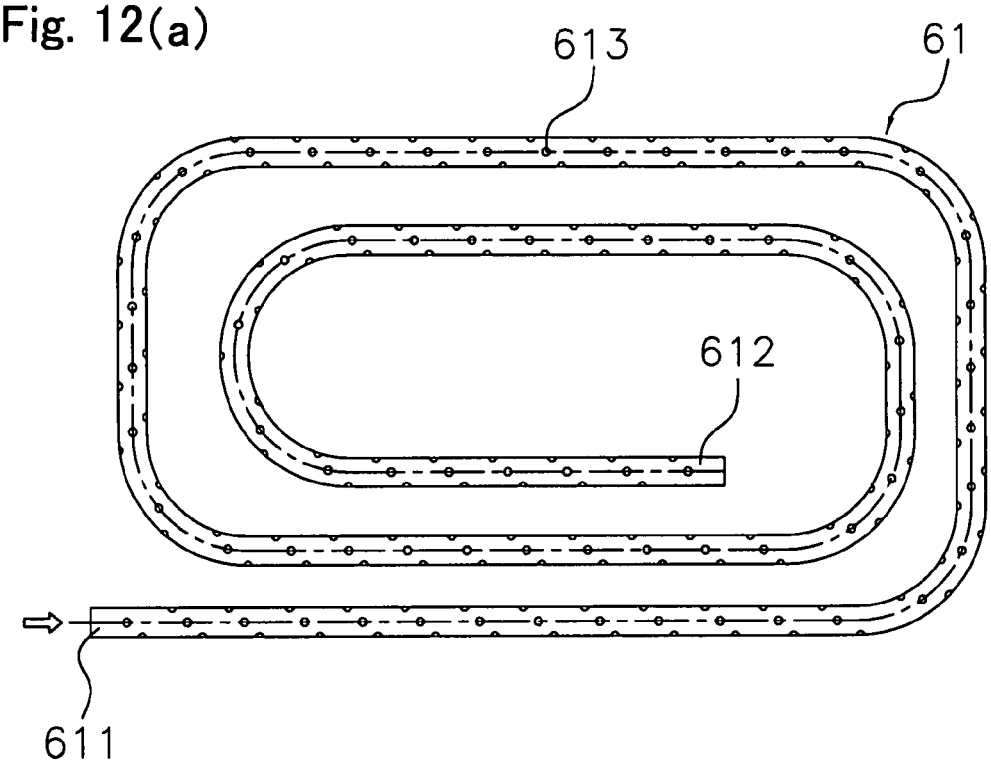
FIG. 12 (*a*) is a plan view of the heat transfer pipe according to the second embodiment; (*b*) is a perspective view of the heat transfer pipe according to the second embodiment; and (*c*) is a perspective view of another heat transfer pipe of the second embodiment.
Figure 12B:
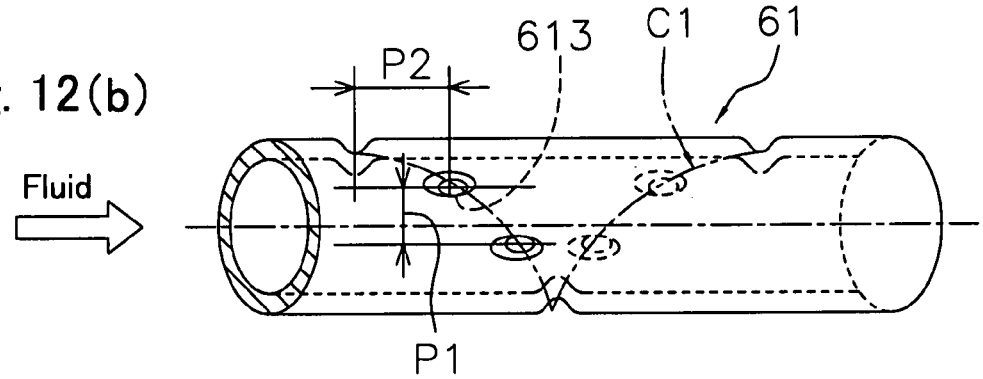
Figure 12C:
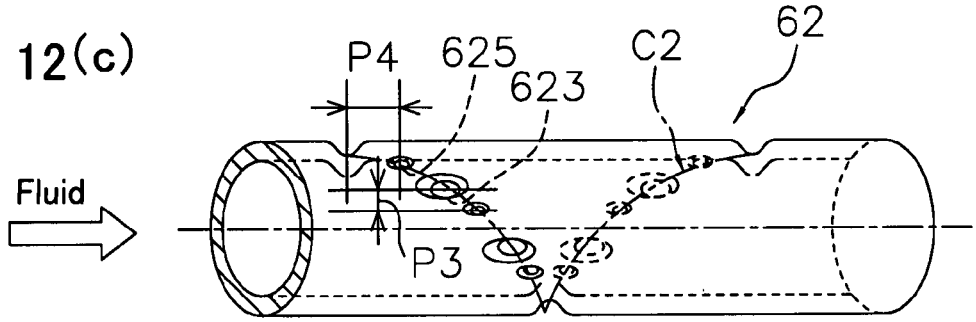

As shown in FIG. 12, a heat transfer pipe 61 employed in the second embodiment is provided with projections 613 along a helix C1 on the pipe inner surface. FIG. 12 (*a*) is a plan view of the heat transfer pipe 61, and FIG. 12 (*b*) is a perspective view of the heat transfer pipe 61. Furthermore, the height H1 of the projections 613 is 1.0 mm, a pitch P1 in the circumferential direction is 6.0 mm, and a pitch P2 in the pipe axial direction is 6.0 mm.

A heat transfer pipe 62 shown in FIG. 12 (*c*) is provided with small projections 625 each whose height H2 is 0.3 mm between projections 623 each whose height H1 is 1.0 mm. Furthermore, a pitch P3 in the circumferential direction is 2.0 mm, and a pitch P4 in the pipe axial direction is 2.0 mm.

Third Embodiment

Figure 13:
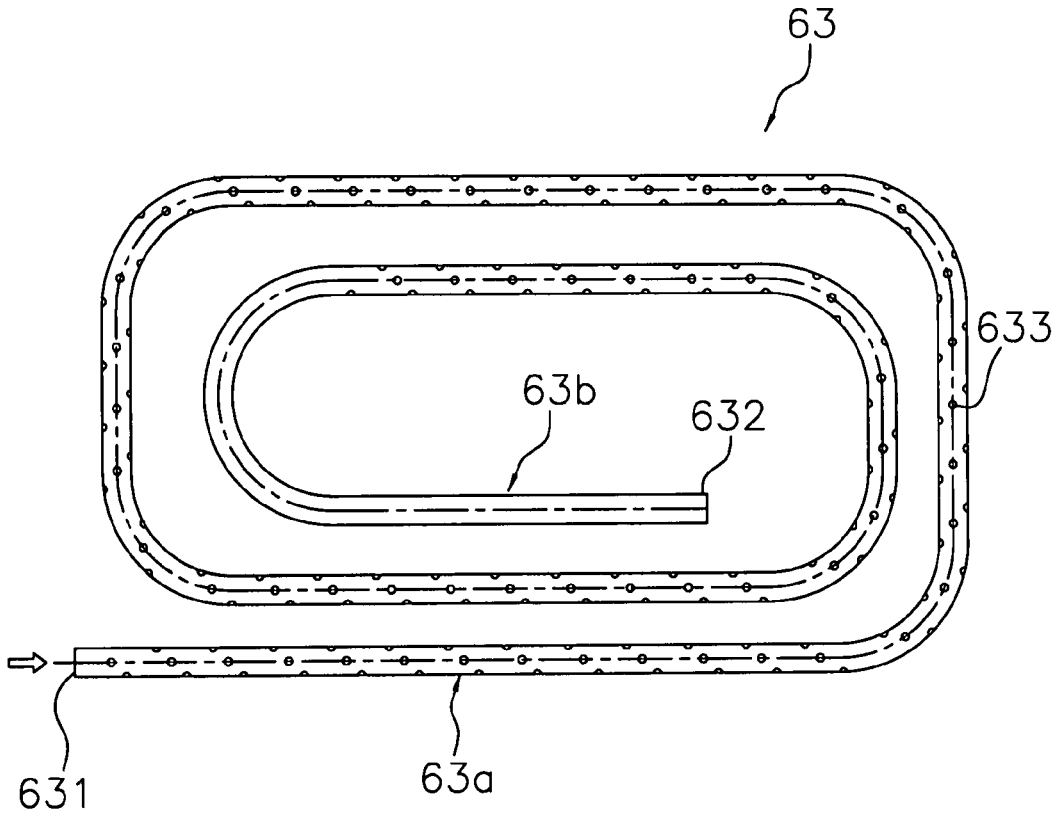
FIG. 13 is a plan view of the heat transfer pipe according to the third embodiment.

As shown in FIG. 13, a heat transfer pipe 63 employed in the third embodiment comprises a section 63*a* provided with projections 633, and a section 63*b* not provided with projections. Furthermore, the section 63*b* not provided with projections is positioned in the vicinity of a water outlet 632. The temperature of the water, which is a fluid, is high in the vicinity of the outlet 632 of the heat transfer pipe 63, and there is therefore a risk of scaling of the pipe wall. If projection parts are provided in such a section, then it may promote scaling. Therefore, scaling is suppressed by not providing projections in the section 63*b* positioned in the vicinity of the water outlet 632, where the water temperature is high.

Fourth Embodiment

Figure 14:
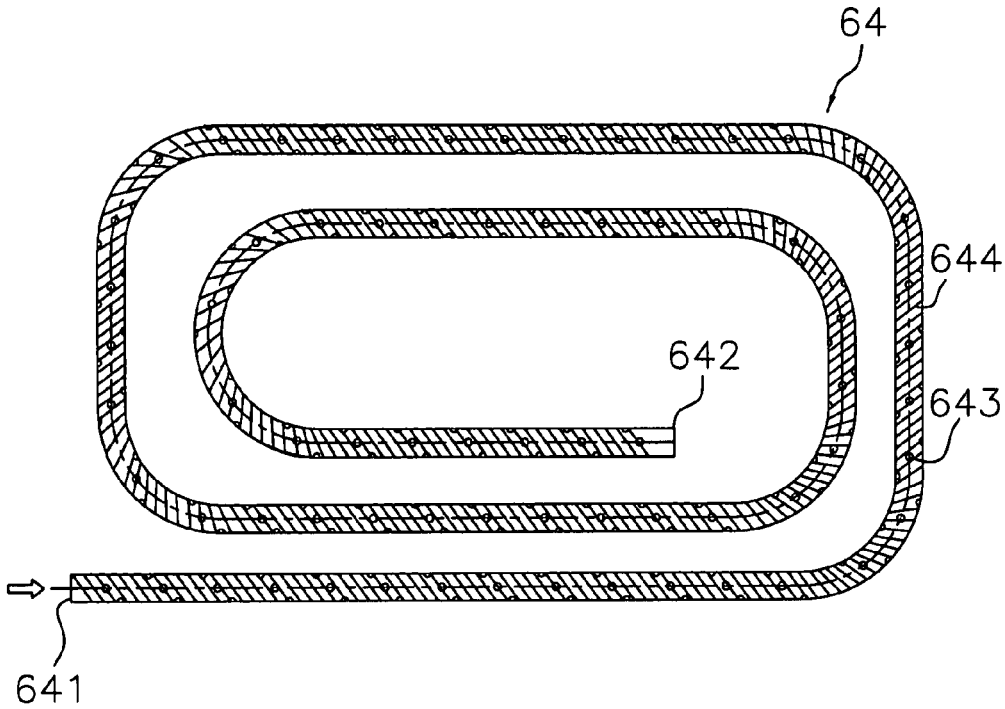
FIG. 14 is a plan view of the heat transfer pipe according to the fourth embodiment.
Figure 14:
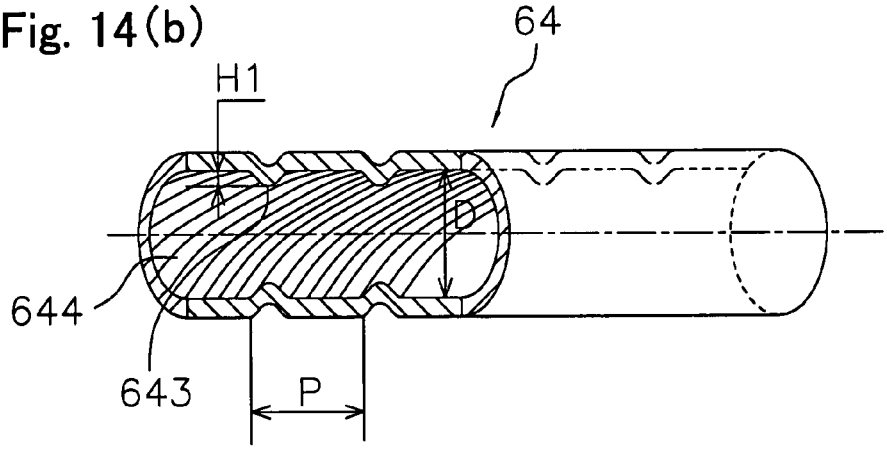

As shown in FIG. 14, a heat transfer pipe 64 employed in the fourth embodiment is a grooved pipe provided with grooves 644 each having a depth of 0.2 mm, and wherein projections 643 each having a height H1 of 1.0 mm are provided vertically symmetric so that their pitch P in the pipe axial direction is 20 mm. Further, the grooves 644 are represented by lines. Herein, providing the projections 643 in the pipe provided with grooves 644 achieves a synergistic effect for the entire heat transfer pipe due to the grooves 644 and the projections 643.

Fifth Embodiment

Figure 15:
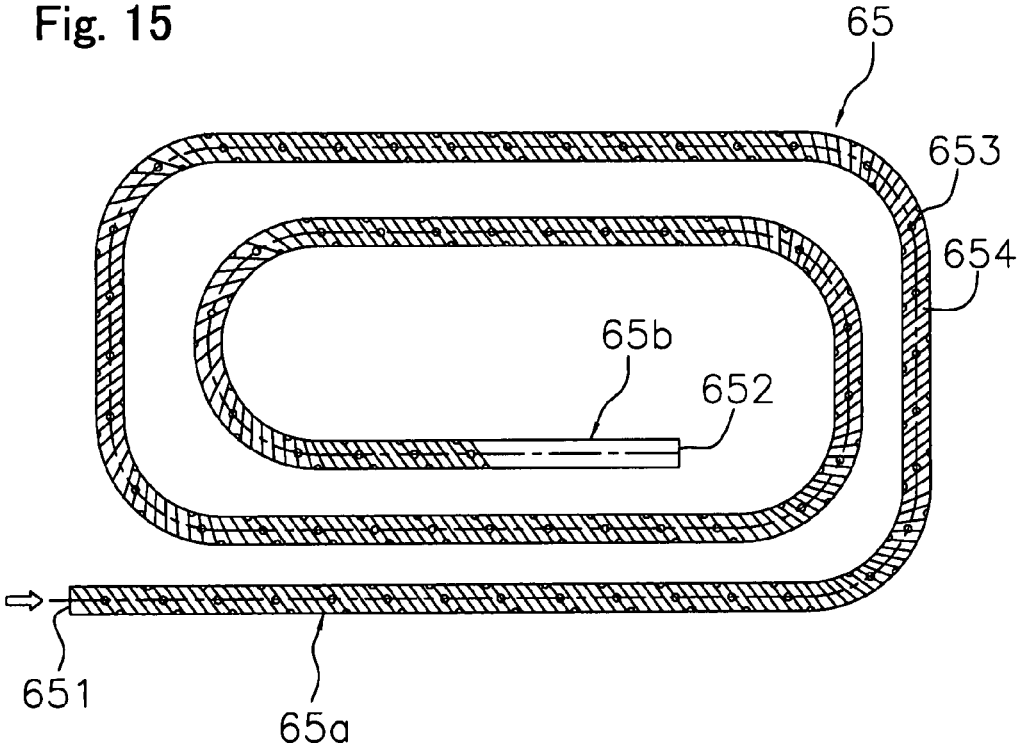
FIG. 15 is a plan view of the heat transfer pipe according to the fifth embodiment.

As shown in FIG. 15, a heat transfer pipe 65 employed in the fifth embodiment comprises a section 65*a* and a section 65*b*. A smooth pipe is used in the section 65*b* positioned in the vicinity of a water outlet 652; in the other section 65*a*, projections 653 each having a height of 1.0 mm are provided in the grooved pipe provided with grooves 654 each having a depth of 0.2 mm. The grooves 654 are represented by lines. In addition to the grooves 654 and the projections 653 achieving a synergistic effect for the entire heat transfer pipe, scaling is suppressed in the section 65*b* positioned in the vicinity of the water outlet 652, where the water temperature is high.

Sixth Embodiment

Figure 16:
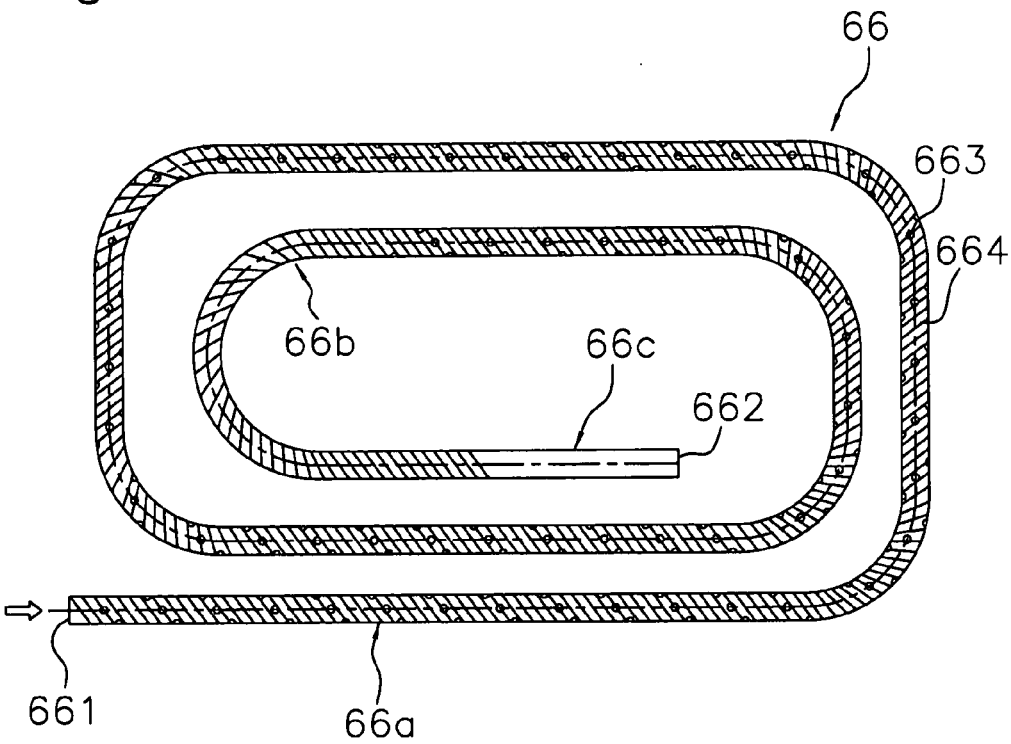
FIG. 16 is a plan view of the heat transfer pipe according to the sixth embodiment.

As shown in FIG. 16, a heat transfer pipe 66 employed in the sixth embodiment comprises three sections: a section 66*a*, a section 66*b*, and a section 66*c*. In the section 66*a* from a water inlet 661 until the Reynolds number Re inside the pipe is 4,000, a grooved pipe provided with grooves 664 each having a depth of 0.2 mm is employed, wherein projections 663 each having a height of 1.0 mm are provided; in the section 66*c* positioned in the vicinity of a water outlet 662, a smooth pipe provided with neither grooves nor projections is employed; and the grooved pipe section 66*b* with grooves 664 each having a depth of 0.2 mm is employed between the section 66*a* and the section 66*c*. Herein, the grooves 664 are represented by lines. Further, a synergistic effect is achieved in that the projections 663 and the grooves 664 improve heat transfer performance in the section where the Reynolds number is low, and the grooves 664 improve heat transfer performance in the section where the Reynolds number is high, thereby improving the performance of the entire heat exchanger. In addition, scaling is suppressed in the section 66*c* positioned in the vicinity of the water outlet 662, where the water temperature is high.

Seventh Embodiment

Figure 17:
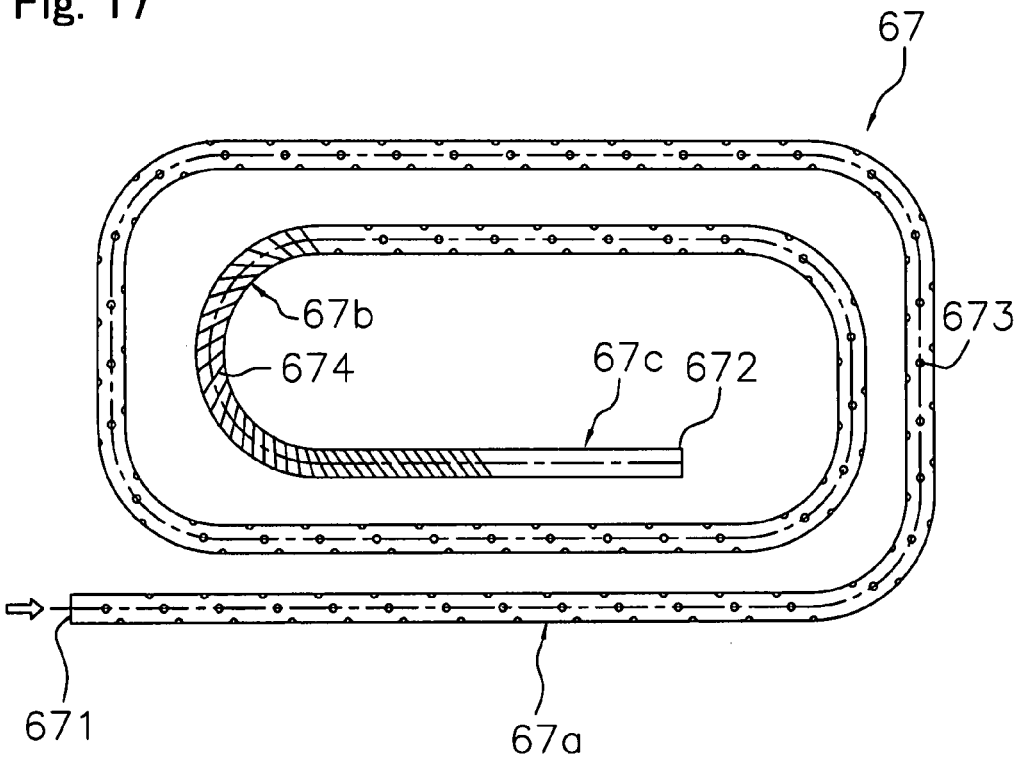
FIG. 17 is a plan view of the heat transfer pipe according to the seventh embodiment.

As shown in FIG. 17, a heat transfer pipe 67 employed in the seventh embodiment comprises three sections: a section 67*a*, a section 67*b*, and a section 67*c*. A pipe provided with projections 673 each having a height of 1.0 mm is used in the section 67*a* from a water inlet 671 until the Reynolds number Re inside the pipe is 4,000; a smooth pipe is used in the section 67*c* positioned in the vicinity of a water outlet 672; and a grooved pipe section 67*b* with grooves 674 each having a depth of 0.2 mm is used between the section 67*a* and the section 67*c*. Herein, the grooves 674 are represented by lines. Furthermore, a synergistic effect is achieved in that the projections 673 improve heat transfer performance in the section where the Reynolds number is low, and the grooves 674 improve heat transfer performance in the section where the Reynolds number is high, thereby improving the performance of the entire heat exchanger. In addition, scaling is suppressed in the section 67*c* positioned in the vicinity of the water outlet 672, where the water temperature is high.

Eighth Embodiment

Figure 18:
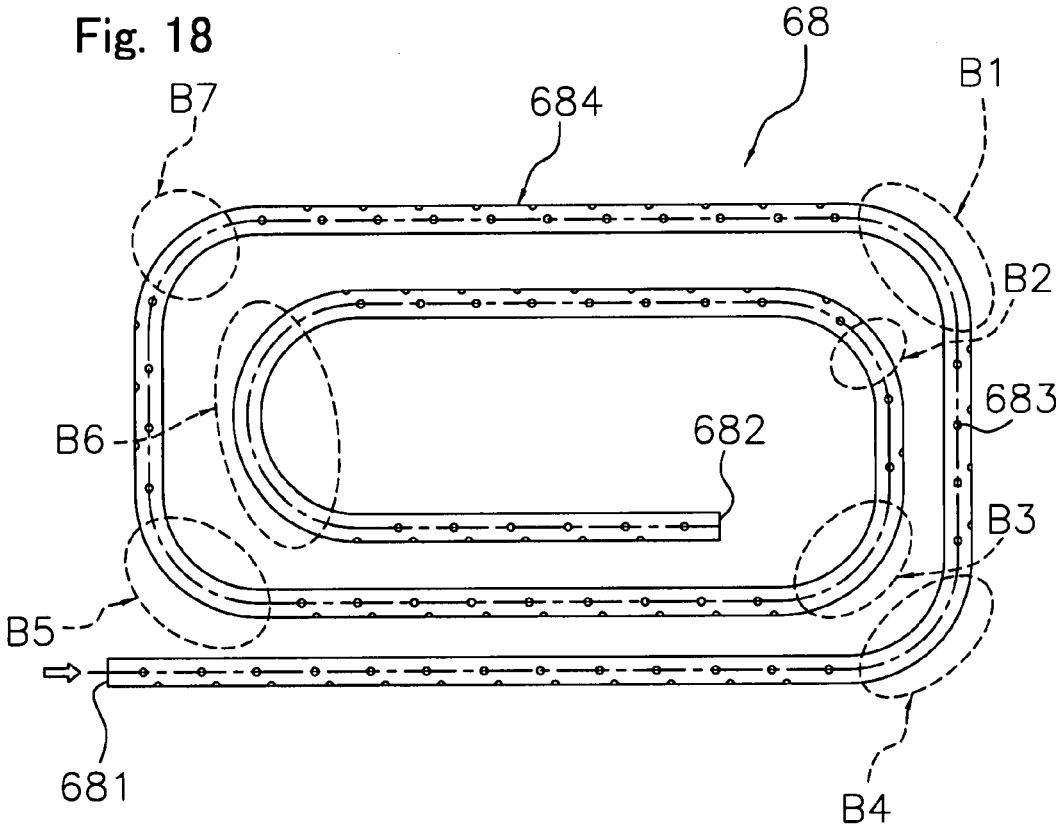
FIG. 18 is a plan view of the heat transfer pipe according to the eighth embodiment.

In a heat transfer pipe 68 used in the eighth embodiment as shown in FIG. 18, projections 683 are provided in a linear part 684, but projections are not provided in the bent parts B1-B7. Providing projections on the inner surface of the bent parts B1-B7 avoids increasing the pressure loss in the pipe, and can also avoid the occurrence of large deformations, breaks, and the like, during the bending work process.

Ninth Embodiment

Figure 19:
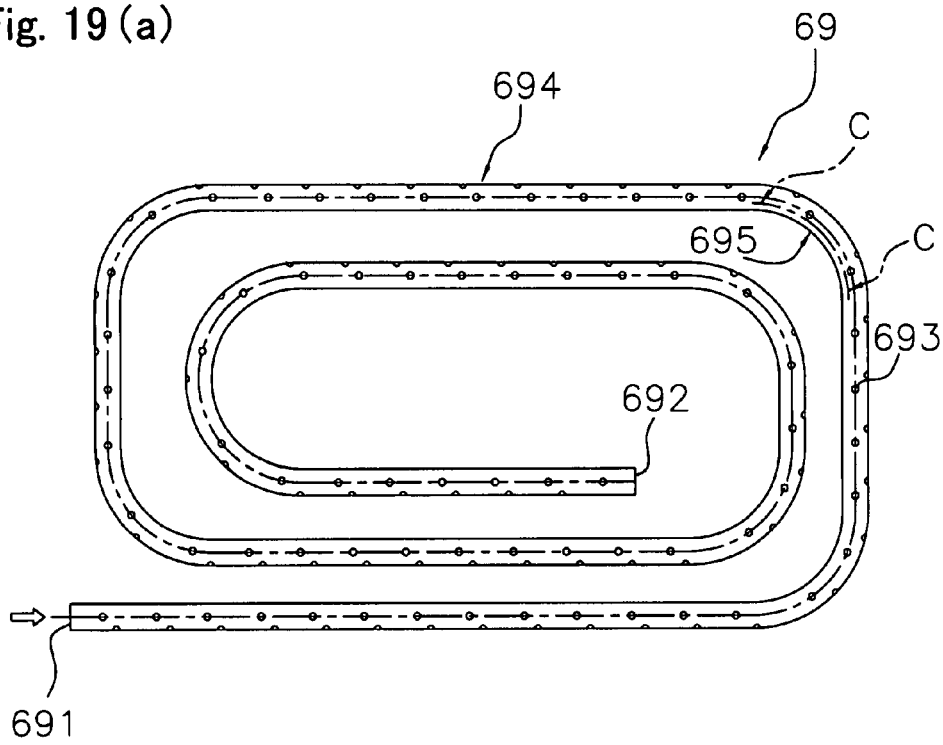
FIG. 19 (*a*) is a plan view of the heat transfer pipe according to the ninth embodiment; and (*b*) is a perspective view of the heat transfer pipe according to the ninth embodiment.
Figure 19:
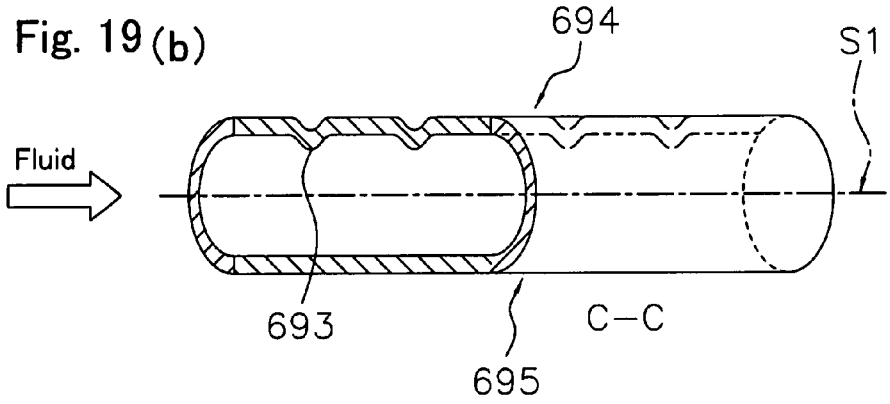

FIG. 19 (*a*) is a plan view of a heat transfer pipe 69 used in the ninth embodiment, and FIG. 19 (*b*) is a perspective view of the heat transfer pipe 69. Herein, projections 693 are provided in a linear part 694, but projections are not provided in a section 695 that intersects with a bent surface SI in a bent part C-C.

Tenth Embodiment

Figure 20:
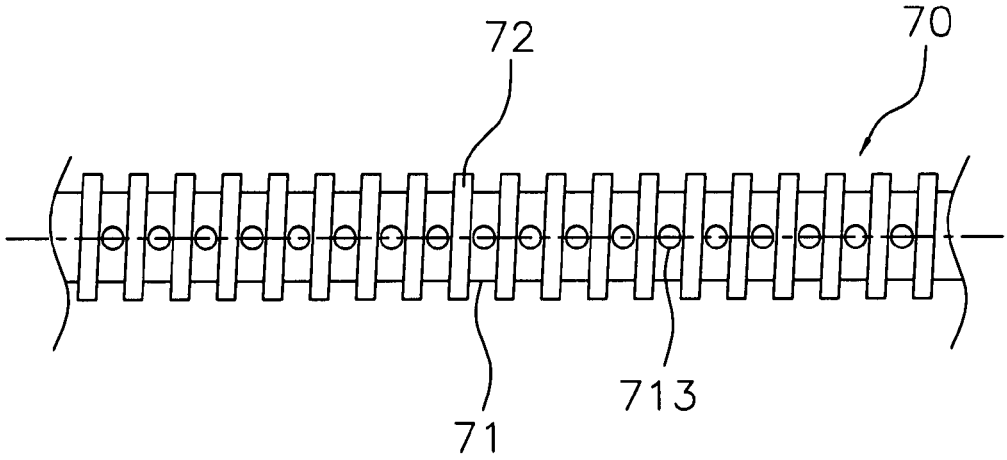
FIG. 20 is a plan view of the heat transfer pipe according to the tenth embodiment.

In a heat transfer pipe 70 used in the tenth embodiment as shown in FIG. 20, projections are not used in a contact region between an outer surface 71 and a refrigerant pipe 72 of the heat transfer pipe. If indents were provided on the pipe outer surface corresponding to the region around which the refrigerant pipe 72 is wound, then the contact between the refrigerant pipe 72 and the heat transfer pipe outer surface 71 would degrade, creating a risk of decreasing the effect of the transfer of heat from the refrigerant pipe 72. Therefore, providing projections 713 in the region where the refrigerant pipe 72 is not wound around can prevent a reduction in the effect of transferring heat from the refrigerant pipe 72.

Eleventh Embodiment

Figure 21A:
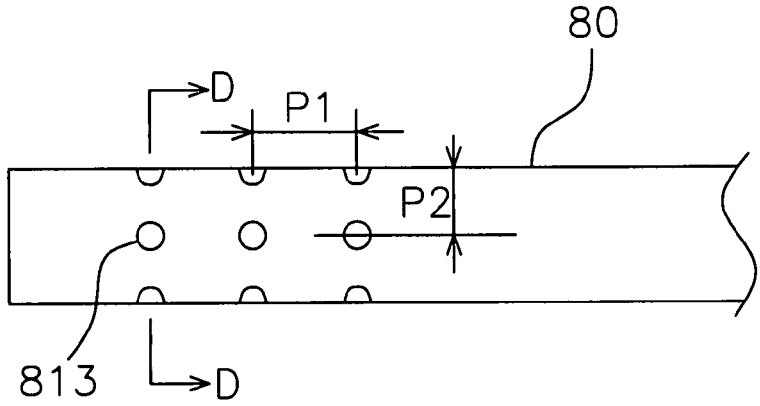
FIG. 21 (*a*) is a plan view of the heat transfer pipe according to the eleventh embodiment; and (*b*) is a cross sectional view taken along the D-D arrow in (*a*).
Figure 21B:
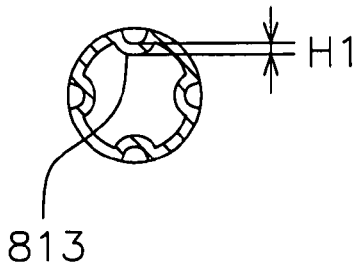

FIG. 21 (*a*) is a plan view of a heat transfer pipe 80 used in the eleventh embodiment, and FIG. 21 (*b*) is a cross sectional view taken along the D-D arrow in FIG. 21 (*a*). As can be seen in FIG. 21 (*a*), projections 813 each having a height H1 of 1.0 mm are provided vertically and horizontally symmetric so that the pitch P1 in the pipe axial direction is 20 mm, and the pitch P2 in the circumferential direction is approximately 6.0 mm.

EFFECTS OF THE INVENTION

According to the present invention, the following effects are obtained, as discussed in the above explanation.

In the first aspect of the present invention, a plurality of projections each having a height H1 of 0.8-2.0 mm is provided in at least one part of the inner surface of a portion positioned in a section where the Reynolds number Re of a fluid flowing in the interior is less than 7,000. Thereby, even in thelow Reynolds number section arising where the flow inside the pipe is in the laminar flow zone and the transition from the laminar flow zone to the turbulent flow zone, the coefficient of heat transfer due to the projections provided inside the pipe improves, the impact of the projections on the pressure loss inside the pipe is suppressed, and the performance of the overall heat transfer pipe improves. It is particularly preferable that the height of the projections is within the range of 0.9-1.2 mm. In addition, it is preferable that the outer diameter of the heat transfer pipe is 8-14 mm (inner diameter of 6-12 mm).

In the second aspect of the present invention, a plurality of projections each whose height H1 is 0.1-0.25 times an inner diameter D is provided in at least one part of the inner surface of a portion positioned in a section where the Reynolds number Re of a fluid flowing in the interior is less than 7,000. Thereby, even in the low Reynolds number section arising where the flow inside the pipe is in the laminar flow zone and the transition from the laminar flow zone to the turbulent flow zone, the coefficient of heat transfer due to the projections provided inside the pipe improves, the impact of the projections on the pressure loss inside the pipe is suppressed, and the performance of the entire heat transfer pipe improves. It is particularly preferable that the relative roughness (HUD) of the projections is within the range of 0.11-0.15.

The third aspect of the present invention is a heat transfer pipe used in a heat exchanger of a hot water heater, wherein a plurality of projections each whose height H1 is 0.8-2.0 mm is provided on the inner surface of a portion positioned in the vicinity of an inlet into which water, which is the fluid flowing in the interior, flows. As a result, the coefficient of heat transfer due to the projections provided inside the pipe is improved, and the impact of the projections on the pressure loss inside the pipe is suppressed, thereby improving the performance of the entire heat transfer pipe. It is particularly preferable that the height of the projections is within the range of 0.9-1.2 mm.

The fourth aspect of the present invention is a heat transfer pipe used in a heat exchanger of a hot water heater, wherein a plurality of projections each whose height H1 is 0.1-0.25 times the inner diameter D is provided on the inner surface of a portion positioned in the vicinity of a fluid inlet into which water, which is the fluid flowing in the interior, flows. Thereby, the coefficient of heat transfer due to the projections provided inside the pipe improves, the impact of the projections on the pressure loss inside the pipe is suppressed, and the performance of the overall heat transfer pipe improves. It is particularly preferable that the relative roughness (HUD) of the projections is within the range of 0.11-0.15.

The fifth aspect of the present invention is a hot water heat transfer pipe as recited in any one of the first through the fourth aspect of the present invention, wherein the flow speed of the fluid flowing in the interior is 0.1-0.6 m/s. Further, if the flow speed of the fluid inside the pipe is less than 0.1 m/s, then the coefficient of heat transfer of the heat transfer pipe is extremely low. However, if the flow speed of the fluid inside the pipe exceeds 0.6 m/s, then the friction factor inside the pipe increases, and the pressure loss inside the pipe increases. Accordingly, the range of the flow speed of the fluid flowing in the interior is set to 0.1-0.6 m/s. As a result, the coefficient of heat transfer due to the projections provided inside the pipe improves, and the impact of the projections on the pressure loss inside the pipe is suppressed, thereby improving the performance of the entire hot water heat transfer pipe.

The sixth aspect of the present invention is a hot water heat transfer pipe as recited in any one of the first through the fourth aspect of the present invention, wherein the cross sectional shape at an arbitrary height of each projection is a smooth curve like a circle, an ellipse, or an approximate circle.

Further, because the outer circumferential surface of the projections are formed with a smooth curved surface, the generation of separation vortices can be suppressed compared with projections that are acute angle shaped, and the impact of the loss of pressure of the fluid inside the pipe is suppressed, thereby improving the performance of the entire heat transfer pipe.

The hot water heat transfer pipe according to the seventh aspect of the present invention is a hot water heat transfer pipe as recited in any one of the first through the fourth aspect of the present invention, wherein the projections are not provided in a section positioned in the vicinity of a fluid outlet out of which the fluid flows.

If the temperature of the fluid is high at the fluid outlet part of the heat transfer pipe and, for example, the fluid is water, then there is a risk of scaling of the pipe inner surface. If projections are provided in such a section, then there are cases where the projections will promote scaling. Accordingly, scaling is suppressed by the usage of a pipe not provided with projections, e.g., by using a smooth pipe, in the section positioned in the vicinity of the fluid outlet, where the temperature of the fluid is high.

The eighth aspect of the present invention is a hot water heat transfer pipe as recited in any one of the first through the fourth aspect of the present invention, wherein a groove having a depth shallower than the height H1 of each projection is formed on the inner surface.

Among the projections provided on the pipe inner surface in the low Reynolds number zone, the large projections contribute more to the improvement in the coefficient of heat transfer than the small projections. Accordingly, providing inside a pipe projections each whose height is greater than the depth of grooves in a grooved pipe improves the heat transfer effect. However, in the high Reynolds number zone, grooves shallower than the height of the projections contribute to the improvement in the coefficient of heat transfer. Accordingly, in the high Reynolds zone, the heat transfer performance of the heat transfer pipe is further improved by the usage of the grooved pipe, wherein grooves shallower than the height of the projections are formed on the inner surface.

The ninth aspect of the present invention is a hot water heat transfer pipe as recited in any one of the first through the fourth aspect of the present invention, wherein the plurality of projections is provided parallel to the pipe axial direction.

Providing projections in the pipe axial direction enables the promotion of heat transfer to be made continuously. In addition, because the fluid flows linearly in the pipe axial direction, the additional pressure loss is small, thereby improving the performance of the entire heat transfer pipe.

The tenth aspect of the present invention is a hot water heat transfer pipe as recited in any one of the first through the fourth aspect of the present invention, wherein the plurality of projections is helically provided.

Helically providing the projections generates a turning in the flow of the fluid inside the pipe, and increases the length of the passage of the fluid, thereby further increasing the heat transfer performance.

The eleventh aspect of the present invention is a hot water heat transfer pipe as recited in any one of the first through the fourth aspect of the present invention, wherein the plurality of projections is provided so that they are paired at opposing positions in the radial direction of the heat transfer pipe.

Providing projections so that they form pairs at opposing positions in the radial direction reduces the cross sectional area in the vicinity of the projections, promotes the mixing of the fluid, and further improves the heat transfer performance.

The twelfth aspect of the present invention is a hot water heat transfer pipe as recited in any one of the first through the fourth aspect of the present invention, wherein the ratio of a pitch P to the heat transfer pipe inner diameter D of the plurality of projections is 0.5-10.

Setting the ratio of the pitch P of the projections to the heat transfer pipe inner diameter D to 0.5-10 maintains the promotion of heat transfer while reducing the increase in the pressure loss, thereby improving the performance of the entire heat transfer pipe. It is particularly preferable to set the ratio of the projection pitch P of the heat transfer pipe to the heat transfer pipe inner diameter D to 0.8-4.0.

The thirteenth aspect of the present invention is a hot water heat transfer pipe as recited in any one of the first through the fourth aspect of the present invention, wherein small projections each whose height H2 is less than 0.8 mm are provided between the plurality of projections.

In the low Reynolds number zone, the large projections contribute more to the improvement in the coefficient of heat transfer than the small projections, and, in the high Reynolds number zone, the small projections contribute more to the improvement in the coefficient of heat transfer than the large projections. Accordingly, providing small projections (small projections) between the large projections achieves a synergistic effect in that the heat transfer performance due to the large projections is improved in the section where the Reynolds number is low, and the heat transfer performance due to the small projections is improved in the section where the Reynolds number is high, thereby improving the performance of the entire heat exchanger.

The fourteenth aspect of the present invention is a hot water heat transfer pipe as recited in any one of the first through the fourth aspect of the present invention, wherein a flat surfaced part not provided with projections exists on the inner surface of the heat transfer pipe.

The existence of a flat surfaced part not provided with projections maximizes the variation in the shape of the heat transfer pipe inner surface, thereby improving heat transfer performance.

The fifteenth aspect of the present invention is a hot water heat transfer pipe as recited in any one of the first through the fourth aspect of the present invention, wherein the projections are formed by the application of force from the exterior, are formed in a linear part, and are not formed in a bent part.

If the projections are formed on the inner surface of the heat transfer pipe by the application of an external force, then it is often the case that the projections are formed toward the inside of the pipe on the inner surface corresponding to the indented outer surface. In addition, the heat transfer pipe generally has a linear part and a bent part. An additional pressure loss exists in the bent part over and above the pressure loss in the linear part. Therefore, if projections are further provided on the inner surface of the bent part, there is a risk that the pressure loss in the bent part will increase further. In addition, the bending work process creates a large deformation in the concave region of the outer surface of the heat transfer pipe, which creates a risk of breakages, and the like. Therefore, the projections are provided in the linear part, and projections are not provided in the bent part.

The sixteenth aspect of the present invention is a hot water heat transfer pipe as recited in any one of the first through the fourth aspect of the present invention, wherein the projections are formed by the application of force from the exterior, and are not formed in a section that intersects the bent surface in the bent part.

In the bent part of the heat transfer pipe, the amount of deformation is greatest in the portion where the bent surface intersects. Therefore, in the bent part of the heat transfer pipe, projections are not provided in the section where the bent surface intersects. For example, if the heat transfer pipe is bent at a horizontal surface, then projections are not provided at the section where the horizontal surface intersects in the bent part.

The seventeenth aspect of the present invention is a hot water heat transfer pipe as recited in any one of the first through the fourth aspect of the present invention, wherein a second heat transfer pipe is disposed in the exterior to flow a second fluid that supplies heat to the fluid; the second heat transfer pipe contacts an outer surface; and the projections are formed on the inner surface by indenting the outer surface, and are formed at a location outside of the portion that contacts the second heat transfer pipe.

Herein, the projections are formed on the inner surface by indenting the outer surface, and indentations are consequently formed on the outer surface corresponding to the region where the projections are formed on the inner surface. Projections are formed at the portion of contact with the second heat transfer pipe. In other words, if indentations are formed on the outer surface, then the contact between the heat transfer pipe and the second heat transfer pipe worsens, thereby reducing the heat transfer effect from the second heat transfer pipe. Therefore, by not providing projections in the section of contact with the second heat transfer pipe, it is possible to prevent a reduction in the effect of transferring heat from the second heat transfer pipe.

What is claimed is:

1. A hot water heat transfer pipe structure comprising:

a first heat transfer pipe that exchanges heat between an interior and an exterior thereof, the first heat transfer pipe being disposed to carry a first fluid and including a plurality of first projections each having a height of 0.8-2.0 mm disposed at at least one part of an inner surface of the first heat transfer pipe, and a plurality of second projections each having a height of less than 0.8 mm provided between the first projections, a ratio of a pitch to an inner diameter of the first projections being 0.5-10; and a second heat transfer pipe disposed in the exterior to carry a second fluid that exchanges heat with the first fluid, the second heat transfer pipe contacting an outer surface of the first heat transfer pipe, the first projections being formed on the inner surface of the first heat transfer pipe by indenting the outer surface of the first heat transfer pipe, and the first projections being formed at a location outside of a portion of the first heat transfer pipe that contacts the second heat transfer pipe.

2. The hot water heat transfer pipe as recited in claim 1, wherein a flow speed of the fluid flowing in the interior is 0.1-0.6 m/s.

3. The hot water heat transfer pipe as recited in claim 1, wherein a cross sectional shape at an arbitrary height of each of the first projections is a smooth curve.

4. The hot water heat transfer pipe as recited in claim 1, wherein the first projections are provided parallel to a pipe axial direction.

5. The hot water heat transfer pipe as recited in claim 1, wherein the first projections are helically provided.

6. The hot water heat transfer pipe as recited in claim 1, wherein the first projections are provided so at they are paired at opposing positions in the radial direction.

7. A hot water heat transfer pipe structure comprising:

a first heat transfer pipe that exchanges heat between an interior and an exterior thereof, the first heat transfer pipe being disposed to carry a first fluid and including a plurality of first projections each having a height of 0.1-0.25 times an inner diameter disposed at least one part of an inner surface of the first heat transfer pipe, and a plurality of second projections each having a height of less than 0.8 mm provided between the first projections, a ratio of a pitch to an inner diameter of the first projections being 0.5-10; and a second heat transfer pipe disposed in the exterior to carry a second fluid that exchanges heat with the first fluid, the second heat transfer pipe contacting an outer surface of the first heat transfer pipe, the first projections being formed on the inner surface of the first heat transfer pipe by indenting the outer surface of the first heat transfer pipe, and the first projections being formed at a location outside of a portion of the first heat transfer pipe that contacts the second heat transfer pipe.

8. A hot water heat transfer pipe structure used heat exchanger of a hot water heater, the hot water heat transfer pipe structure comprising:

a first heat transfer pipe that exchanges heat between an interior and an exterior thereof, the first heat transfer pipe being disposed to carry a first fluid and including a plurality of first projections each having a height of 0.8-2.0 mm disposed at an inner surface of a portion of the first heat transfer pipe positioned in a vicinity of an inlet of the first heat transfer pipe, a ratio of a pitch to an inner diameter of the first projections bering 0.5-10, and a plurality of second projections each having a height of less than 0.8 mm provided between the first projections; and a second heat transfer pipe disposed in the exterior to carry a second fluid that exchanges heat with the first fluid, the second heat transfer pipe contacting an outer surface of the first heat transfer pipe, the first projections being formed on the inner surface of the first heat transfer pipe by indenting the outer surface of the first heat transfer pipe, and the first projections being formed at a location outside of a portion of the first heat transfer pipe that contacts the second heat transfer pipe.

9. A hot water heat transfer pipe structure used in a heat exchanger of a hot water heater, the hot water heat transfer pipe structure comprising:

a first heat transfer pipe that exchanges heat between an interior and an exterior thereof, the first heat transfer pipe being disposed to carry a first fluid and including a plurality of first projections each having a height of 0.1-0.25 times an inner diameter disposed at an inner surface of a portion of the first heat transfer pipe positioned in a vicinity of an inlet of the first heat transfer pipe, a ratio of a pitch to an inner diameter of the first projections being 0.5-10, and a plurality of second projections each having a height of less than 0.8 mm provided between the first projections; and a second heat transfer pipe disposed in the exterior to carry a second fluid that exchanges heat with the first fluid, the second heat transfer pipe contacting an outer surface of the first heat transfer pipe, the first projections being formed on the inner surface of the first heat transfer pipe by indenting the outer surface of the first heat transfer pipe, and the first projections being formed at a location outside of a portion of the first heat transfer pipe that contacts the second heat transfer pipe.

* * * * *